United States Patent [19]

Soderberg et al.

[11] 4,380,295

[45] Apr. 19, 1983

[54] AUTOMATIC DRILL DEBURRING AND SORTING MACHINE

[75] Inventors: Mark S. Soderberg, Seattle; Albert L. Hametner, West Seattle; Herman F. Leppink, Renton; David E. Strand, Seattle, all of Wash.

[73] Assignee: The Boeing Company, Seattle, Wash.

[21] Appl. No.: 251,190

[22] Filed: Apr. 6, 1981

[51] Int. Cl.[3] ..... B07C 5/00; B21H 3/10

[52] U.S. Cl. ..... 209/558; 209/655; 209/598; 209/605; 209/909; 33/143 L; 33/201; 33/172 E; 33/174 L; 33/178 E; 76/5 R

[58] Field of Search ..... 209/556, 555, 558, 564, 209/586, 600, 601, 602, 604, 605, 655, 675, 680, 682, 940, 598, 546, 549, 550; 29/705, 710; 408/241 R; 364/562, 563, 474; 76/5 R; 33/143 L, 201, 172 E, 174 L, 178 E

[56] References Cited

U.S. PATENT DOCUMENTS

| | | | |
|---|---|---|---|
| 2,523,555 | 9/1950 | Boosey | 209/88 |
| 2,717,449 | 9/1955 | Graham | 33/147 |
| 2,771,796 | 11/1956 | Ives | 76/5 R |
| 2,794,551 | 6/1957 | Colling et al. | 209/99 |
| 2,808,742 | 10/1957 | Ives | 76/5 R |
| 2,901,105 | 8/1959 | Harder | 209/88 |
| 2,902,152 | 9/1959 | Wilkes | 209/122 |
| 2,962,166 | 11/1960 | Miles et al. | 209/88 |
| 3,088,591 | 5/1963 | Perthen et al. | 209/602 |
| 3,107,432 | 10/1963 | Dickison et al. | 33/143 |
| 3,126,642 | 3/1964 | Nickols | 33/174 |
| 3,226,833 | 1/1966 | Lemelson | 33/143 |
| 3,609,053 | 9/1971 | Klem | 408/16 |
| 3,636,814 | 1/1972 | Esch | 90/11 |
| 3,781,997 | 1/1974 | Pagella et al. | 33/143 |
| 3,875,667 | 4/1975 | Wilke | 33/174 |
| 3,920,971 | 11/1975 | Bevis et al. | 235/151 |
| 3,939,567 | 2/1976 | Albertazzi | 33/143 |
| 3,958,338 | 5/1976 | Anichini et al. | 33/178 |
| 3,962,792 | 6/1976 | Stepanek et al. | 33/143 |
| 3,987,552 | 10/1976 | Raiteri | 33/178 |
| 4,031,628 | 6/1977 | Kaesemeyer | 33/201 |
| 4,084,322 | 4/1978 | Albertazzi | 33/174 |
| 4,146,967 | 4/1979 | Rohner et al. | 33/174 |
| 4,158,917 | 6/1979 | Tagliavini | 33/147 |
| 4,170,067 | 10/1979 | Yohe et al. | 33/143 |

*Primary Examiner*—Allen N. Knowles
*Attorney, Agent, or Firm*—Christensen, O'Connor, Johnson & Kindness

[57] ABSTRACT

Drills (35), vertically oriented in a row/column array in a drill block (31), are moved in the column direction across a slot (49) located at a loading station (41). As the drills in each partially or fully occupied row reach the slot and drop, drill block movement halts. Thereafter a vertically oriented turn-over tube (51) is moved in the row direction beneath the slot (49). When an occupied drill position is reached, the drill drops into the turn-over tube, tube row movement temporarily halts, and the tube is rotated. The drill slides out of the turn-over tube (51) and down the channel (59) of a measuring station (43) until it hits a movable stop (61). After drill diameter is measured by a pneumatically positioned LVDT (87) and overall drill length is measured by a pneumatically positioned linear potentiometer (69)/proximity detector (PX3) combination, the stop (61) is withdrawn and the drill enters a clamp (95), which grips the adapter shank of the drill. The clamp (95) and the drill are moved by an air-over-oil mechanism toward a prepositioned bushing (385) that deburrs the drill when the drill enters the bushing. Drill movement stops when the end of the flutes reach the bushing, at which time the clamp position is measured by a linear potentiometer (100). The overall drill length measurement and the clamp position measurement are combined to determine the length of the drill's flutes. After the clamp (95) returns to its pickup position the drill is dropped into a prepositioned rotatable tray (123) located at a sorting station (47). The tray and a fan-shaped diverter (125) direct the drill into the appropriate upper or lower bin (131, 133). Drills having diameters other than the diameters to be sorted are dropped into the prepositioned tray without being deburred and directed to a non-selected bin. Bent drills (determined by the drill ends impinging on the periphery of the bushing, rather than entering the bushing) and drills with unacceptably short flutes are directed to a reject drill bin. The various mechanisms are controlled by control signals produced by a CPU (501).

45 Claims, 28 Drawing Figures

ACTUATOR VALVE TABLE

| STATION | REF. NO. | FUNCTION | SOLENOID TYPE | DETENT OR SPRING RETURN |
|---|---|---|---|---|
| LOADING | V1 | DRILL BLOCK POSITION | SINGLE | SPRING |
| | V2 | DRILL BLOCK POSITION | SINGLE | SPRING |
| | V3 | TURN-OVER TUBE POSITION (AIR) | SINGLE | SPRING |
| | V4 | TURN-OVER TUBE POSITION (AIR) | SINGLE | SPRING |
| | V5 | TURN-OVER TUBE POSITION (HYDRAULIC) | DOUBLE (ONLY ONE USED) | SPRING (CENTER) |
| | V6 | TURN-OVER TUBE ROTATION | SINGLE | SPRING |
| LENGTH & DIAMETER MEASURE | V7 | STOP RETRACTION | SINGLE | SPRING |
| | V8 | DIAMETER MEASURE | SINGLE | SPRING |
| | V9 | LENGTH MEASURE | SINGLE | SPRING |
| DEBURRING & FLUTE LENGTH MEASURE | V10 | BUSHING POSITION | SINGLE | SPRING |
| | V11 | BUSHING POSITION | DOUBLE | DETENT |
| | V12 | BUSHING POSITION | DOUBLE | DETENT |
| | V13 | BUSHING POSITION | DOUBLE | DETENT |
| | V14 | BUSHING LOCK | SINGLE | SPRING |
| | V15 | DRILL CLAMP (CLOSED) | SINGLE | SPRING |
| | V16 | DRILL CLAMP (OPEN) | SINGLE | SPRING |
| | V17 | CLAMP PUSHER | AIR PILOT | SPRING |
| | V18 | CLAMP FEED | SINGLE | SPRING |
| SORTING | V19 | HORIZONTAL BIN SELECT | DOUBLE | DETENT |
| | V20 | HORIZONTAL BIN SELECT | DOUBLE | DETENT |
| | V21 | HORIZONTAL BIN SELECT | DOUBLE | DETENT |
| | V22 | VERTICAL BIN SELECT | DOUBLE | DETENT |

Fig. 3.

LIMIT SWITCH TABLE

| STATION | REF. NO. | FUNCTION |
|---|---|---|
| LOADING | LS1 | DRILL BLOCK (EMPTY) |
| | LS2 | DRILL BLOCK (HOME) |
| | LS3 | TURN-OVER TUBE (RIGHT) |
| | LS4 | TURN-OVER TUBE (LEFT) |
| | LS5 | TURN-OVER TUBE (UP) |
| LENGTH AND DIAMETER MEASURE | LS6 | STOP RETRACTION |
| DEBURRING AND FLUTE LENGTH MEASURE | LS7 | BUSHING POSITION |
| | LS8 | BUSHING POSITION |
| | LS9 | BUSHING POSITION |
| | LS10 | BUSHING LOCK (LOCKED) |
| | LS11 | BUSHING LOCK (UNLOCKED) |
| | LS12 | DRILL PUSHER |
| SORTING | LS13 | VERTICAL BIN SELECT |

Fig. 5.

PROXIMITY SWITCH TABLE

| STATION | REF. NO. | FUNCTION |
|---|---|---|
| LOADING | PX1<br>PX2 | TURN-OVER TUBE (TOP)<br>TURN-OVER TUBE (BOTTOM) |
| LENGTH & DIA. MEASURE | PX3 | DRILL LENGTH |

Fig. 6.

PRESSURE SWITCH TABLE

| STATION | REF. NO. | FUNCTION |
|---|---|---|
| LOADING | PS1 | DRILL BLOCK |
| DEBURRING & FLUTE LENGTH MEASURE | PS2<br>PS3<br>PS4<br>PS5<br>PS6 | CLAMP FEED<br>DRILL CLAMP (OPEN)<br>DRILL CLAMP (CLOSED)<br>CLAMP FEED<br>FLUTE LENGTH MEASURE |
| SORTING | PS7<br>PS8<br>PS9 | HORIZONTAL BIN SELECT<br>HORIZONTAL BIN SELECT<br>HORIZONTAL BIN SELECT |

Fig. 7.

AUTOMATIC DRILL DEBURRING AND SORTING MACHINE

TECHNICAL AREA

This invention is directed to sorting machines and, more particularly, to machines for deburring and sorting drills.

BACKGROUND OF THE INVENTION

Various sizes and types of drills are widely used in many industrial environments, such as aircraft manufacturing plants, to create holes of varying sizes. Such usage frequently results in various size drills being collected in a common receptacle for resharpening, cleaning, refurbishing, etc. after the drills have become dull, burred, coated, etc. during use. More specifically, new or refurbished drills are usually grouped by size when they are supplied to users to reduce the time required to locate the required size drill for each job, and to avoid mistakes. After use, rather than attempting to keep drills sorted, "spent" drills are collected in a common receptacle. The mixed, spent drills are then refurbished (resharpened, deburred, cleaned, etc., as required) and sorted according to size. This same procedure is followed regardless of whether the drills are conventional, i.e., have shank diameters the same as the flute diameters, or are non-conventional, i.e., have a common diameter adapter shank. Common diameter adapter shank drills are commonly referred to as "quick change" drills because they are designed for use in a chuck that has a fixed size aperture and a mechanism that allows such drills to be rapidly changed.

In the past, regardless of whether they have been conventional or quick change, "spent" drills have been deburred and sorted by hand after being resharpened (if required). Obviously deburring and sorting the large number of drills used in many industrial environments is a time consuming and, thus, costly endeavor. As a result, attempts have been made to automate at least the sorting portion of this procedure. In this regard, one prior art machine automatically separates drills of one diameter from a mixture of drills of various diameters using a linear variable differential transformer (LVDT). In this machine, the flute region of the drill is positioned between a fixed jaw and a movable jaw. The movable jaw is moved toward the fixed jaw until the drill flute is gripped therebetween. Then the position of the movable jaw is determined by the LVDT (which is coupled to the movable jaw), and the resultant information utilized to control whether the drill drops into a selected bin or a non-selected bin. While this machine is a significant advance over the prior art procedure wherein drill size is determined entirely by hand, it has a number of disadvantages. For example, the remainder of the mixture of drills must be repeatedly passed through the machine (the machine being reset prior to each pass) to sort all drill sizes. As a result, machine operation is slower than desired. In addition, each drill must be examined to determine whether or not it is bent and/or is unuseful for other reasons, such as the drill's flute length being too short for the drill to be used in the intended environment. Obviously it would be desirable to provide an automatic drill sorting machine that determines this information as well as simultaneously sorts a plurality of different diameter drills. That is, it would be desirable to provide a machine that, in addition to sorting drills, automatically deburrs drills of the diameters to be sorted, determines if the flute length of each drill is acceptable and identifies bent drills, all in a single operational sequence.

Therefore, it is an object of this invention to provide a new and improved automatic drill sorting machine.

It is also an object of this invention to provide an automatic drill sorting machine that simultaneously sorts a plurality of different diameter and length drills.

It is another object of this invention to provide an automatic drill deburring and sorting machine that deburs, as well as, sorts a plurality of different diameter drills.

It is a further object of this invention to provide an automatic drill sorting machine that identifies bent drills.

It is a still further object of this invention to provide an automatic drill sorting machine that automatically determines the flute length of drills as they are sorted.

It is yet another object of this invention to provide an automatic drill deburring and sorting machine that sorts a plurality of different diameter drills, determines if the flute length of each drill is acceptable and identifies bent drills all in a single operational sequence.

SUMMARY OF THE INVENTION

In accordance with this invention an automatic drill sorting machine is provided. While the drill sorting machine is particularly suitable for use in sorting quick change drills, and was developed for use in the sorting of such drills, it should be understood that the invention can also be utilized to sort conventional drills wherein flute and shank diameter are the same. Further, while the invention is designed to deburr as well as sort drills, drills can be sorted without being deburred, if desired.

The automatic drill sorting machine of the invention includes a loading station whereat drills are loaded one by one into the machine. After a drill enters the machine it is moved to a measuring station whereat the diameter and overall length of the drill is determined. After being measured, the flute length of the drill is determined at a flute length station. Bent drills are detected at the flute length station. The drill then moves to a sorting station whereat it is sorted in accordance with the information developed at the measuring station and the flute length station. Preferably, the drills are also deburred at the flute length station. Thus, the flute length station becomes a deburring and flute length station.

In accordance with further aspects of this invention, prior to loading the drills are vertically oriented (shank down) in a row/column array in a drill block. The loading station includes a drill block positioning mechanism that moves the drill block in the column direction across a slot. As each partially or fully occupied row reaches the slot, the drills in the row drop into the slot and halt block movement. Thereafter a vertically oriented turn-over tube is moved in the row direction beneath the slot. When an occupied drill position is reached, the drill drops into the turn-over tube. When a drill drops into the turn-over tube, turn-over tube row direction movement temporarily halts and the tube is rotated to a position whereat gravity causes the drill to slide out of the tube and down a ramp to the measuring station. Drill movement terminates when the tip of the drill impinges on a movable stop.

In addition to the ramp and the movable stop, the measuring station includes a diameter measuring mechanism and a length measuring mechanism. The length measuring mechanism includes a linear potentiometer having an axis of movement parallel to the ramp longitudinal axis. The potentiometer includes a movable shaft that is extended and retracted by a parallel mounted extension mechanism, such as a pneumatic actuator shaft. A proximity detector is mounted for movement with the shaft of the linear potentiometer. The proximity detector starts at a predetermined position, preferably upstream of the trailing end of a drill stopped by the movable stop, and is moved toward the trailing edge of the drill when the extension mechanism and, thus, the shaft of the linear potentiometer is moved. When the trailing edge of the drill is detected by the proximity sensor, the resistance of the potentiometer is read. As a result, the linear potentiometer resistance value is linearly related to the overall length of the drill.

Preferably, the diameter measuring mechanism portion of the measuring station includes a fixed jaw and a movable jaw located on opposing sides of a drill stopped by said movable stop in the region where the drill flutes are located. The width of the jaws, i.e., the dimension of the jaws that lies parallel to the longitudinal axis of the drill is at least equal to one complete drill flute twist, based on the drill with the longest flute twist of the drills to be sorted. During measurement, the movable jaw is moved toward the fixed jaw so as to grip the drill, in the region of the flute, therebetween, i.e., the movable jaw is moved in a direction perpendicular to the longitudinal axis of the drill. The position of the movable jaw is detected by a linear variable differential transformer (LVDT). The movable jaw is moved by a suitable linear positioning device, such as the shaft of a pneumatic actuator. The output of the LVDT when the drill is gripped between the fixed and movable jaws is linearly related to the diameter of the drill being measured.

In accordance with other aspects of this invention, the deburring and flute length station includes a clamp positioned to grip the shank of a drill after it leaves the measuring station. In addition, the deburring and flute length station includes a plurality of deburring bushings and a positioning mechanism for aligning the aperture in said bushings with the longitudinal axis of a drill held by said clamp. The bushing positioning mechanism positions the correct bushing in alignment with the drill gripped by the clamp based on the flute diameter information developed at the measuring station. After the drill has been gripped by the clamp and the appropriate bushing moved into the deburring position, the clamp and, thus, the drill, is longitudinally moved toward the bushing. If the drill is bent, its tip impinges on the periphery of the bushing aperture. This condition is sensed and the drill is withdrawn. If the drill is straight, its flutes enter the bushing and are deburred. When the end of the flutes reaches the upstream end of the bushing, drill movement stops and the length of the flute is determined based on the overall length of the drill and the position of the clamp when the end of the flutes reach the bushing. Thereafter, clamp movement is reversed and the drill is withdrawn.

In accordance with further aspects of this invention, the sorting station includes a rotatable tray mounted beneath the clamp's start position. Thus, when the clamp is opened at the start position, a drill previously gripped by the clamp drops into the tray. In addition to the rotating tray, the sorting station includes a plurality of bins and a diverting mechanism for diverting each drill into the selected bin. The selected bin is determined by the information developed at the measuring station and the deburring and flute length station. In this regard, in addition to sorting a predetermined number of sizes and types of drills, such as five sizes of two types, into an equal number of bins (e.g., ten), the sorting station includes one or more reject bins into which drills of non-sorted sizes and bent drills or drills with other defects, such as too short of a flute length, are collected. The types of drills may be the jobber and six inch types commonly used in the aircraft industry, for example. Each such type includes quick change drills of the same flute diameter, the difference residing in the length of the drill.

In the most preferred form of the invention, the automatic drill sorting machine is controlled by a central processing unit that controls the actuation of valves that in turn control the various drill positioning and movement mechanisms. In this regard, most preferably, the turn-over tube is moved in the row direction by an air-over-oil positioning mechanism, so that row movement can be stopped essentially instantaneously. Similarly, preferably, the clamp is moved toward and away from the deburring bushing by an air-over-oil system so that movement can be stopped substantially instantaneously when the end of the flutes start to enter the bushing. In this regard, preferably, entry of the end of the flutes is detected by a pneumatic mechanism formed such that air exits from a chamber (located downstream of the bushing) about the drill flutes prior to the end of the flutes reaching the upstream end of the bushing. When the upstream end is reached air pressure in the chamber increases. The pressure increase is detected and creates a signal that causes clamp and, thus, drill movement to stop. When this occurs the position of a linear potentiometer whose shaft is coupled to the clamp to move with the clamp is read to provide data that, when combined with the overall length data developed at the measuring station, defines the length of the drills flutes.

As will be readily appreciated from the foregoing summary, the invention provides a system for automatically sorting a plurality of different sized drills. Not only are the drills sorted, they are also deburred, if desired. Further, not only are the drills automatically deburred and sorted based on their type and diameter, the drills are also tested to determine whether or not their flute lengths are suitably long and whether or not the drills are straight or bent. Drills with unsuitably short flute lengths and/or drills that are bent are directed to a suitable reject bin. Similarly drills of a non-sorted size are directed to a non-selected bin.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 3 is an actuator valve table defining the location, reference number, funtion and nature of the actuator valves controlling the actuators included in the preferred embodiment of the invention;

FIG. 5 is a limit switch table defining the location, reference number and function of the limit switches illustrated in FIG. 4;

FIG. 6 is a proximity switch table defining the location, reference number and function of the proximity switches illustrated in FIG. 4;

FIG. 7 is a pressure switch table defining the location, reference number and function of pressure switches included in the preferred embodiment of the invention;

DESCRIPTION OF THE PREFERRED EMBODIMENT

Figure 1:
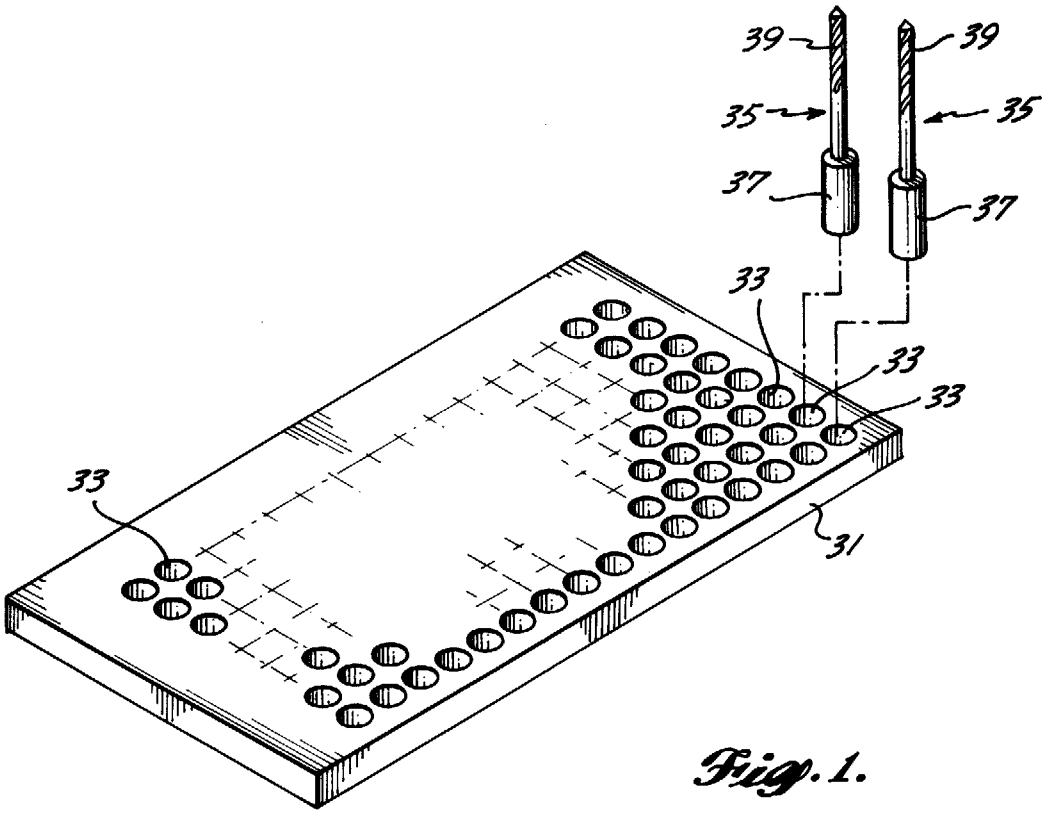
FIG. 1 is a pictorial diagram illustrating the vertical mounting of a plurality of quick change drills in row/column matrix apertures in a drill block.

FIG. 1 illustrates a drill block 31 suitable for supporting a plurality of quick change drills 35. The drill block 31 is formed of a flat block of a suitably rigid material, such as plastic, metal, etc. Extending between the faces of the drill block 31 are a plurality of equal sized cylindrical holes 33. While the holes could be randomly oriented, preferably, they define a row/column matrix. Each hole 33 is intended to receive the shank 37 of one of the quick change drills 35. As will be readily appreciated by those skilled in the art and others, quick change drills are drills having a common diameter adapter shank 37, such as a quarter inch, three-eighths inch, one-half inch, etc. While the adapter shank diameter is common and larger than drill diameter, obviously, the flute diameter 39 of each drill depends upon the size of the hole to be drilled by each particular drill. Quick change drills are utilized in various environments, particularly the aircraft industry, to avoid the necessity of rotationally readjusting a chuck aperture each time a drill is changed and, thus, increase the speed of drill change operations. Further, in the aircraft industry such drills are one of two different types—jobber and six inch. Both types include drills of the same drill diameter, the difference in type being based on drill length.

The adaptor shank ends of the quick change drills 35 are located in the holes 33 in the drill block 31 such that flute ends of the drills project outwardly from the same face of the block. As will be better understood from the following discussion, the drill block 31 is supported in a horizontal plane, whereby the drills 35 are vertical.

Figure 2:
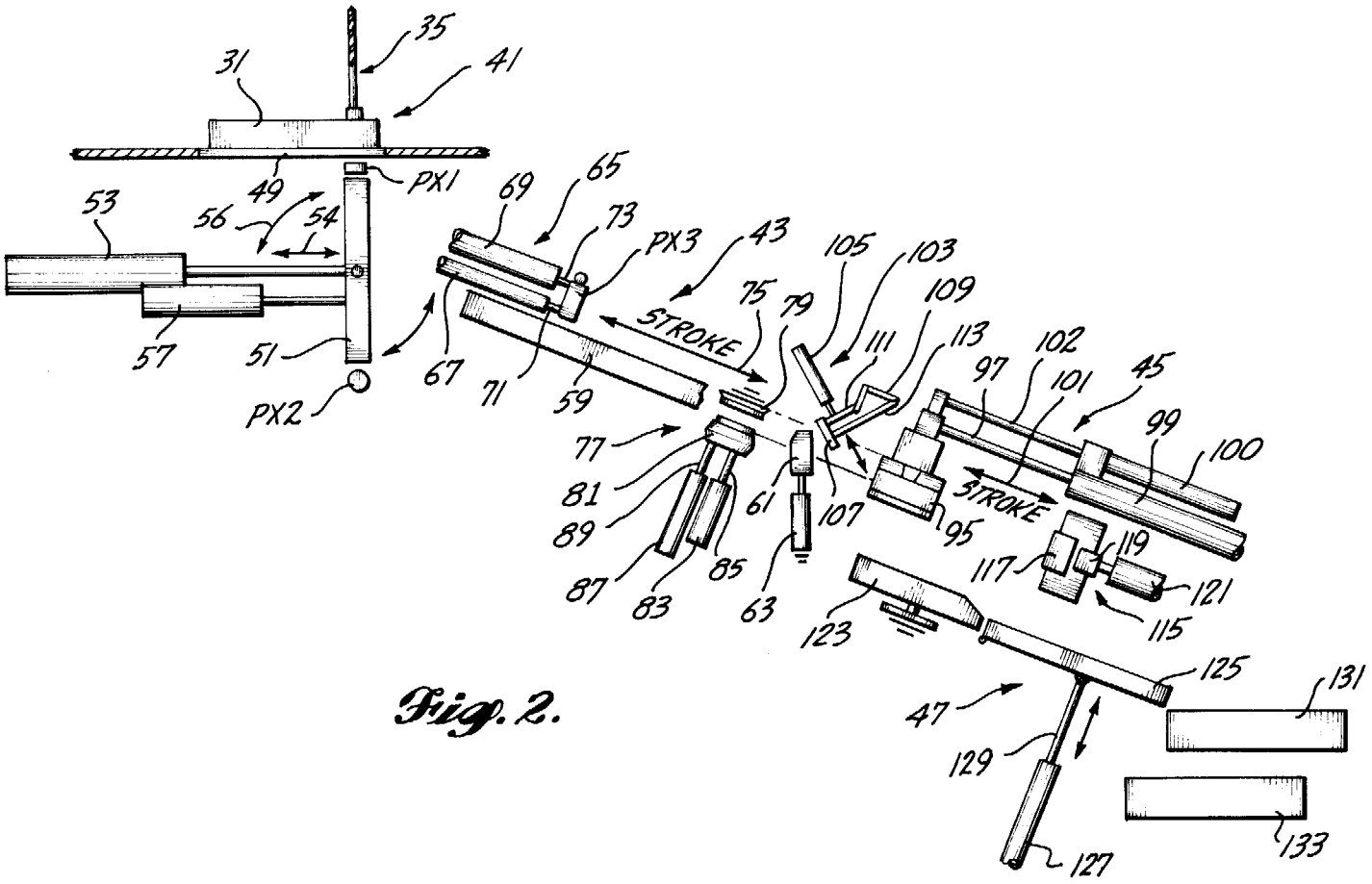
FIG. 2 is a pictorial diagram illustrating the position and operation of the loading station, the measuring station, the deburring and flute length station, and the sorting station of the preferred embodiment of an automatic drill deburring and sorting machine formed in accordance with the invention.

FIG. 2 is a pictorial diagram illustrating the location and general nature of: a loading station 41; a measuring station 43; a deburring and flute length station 45; and, a sorting station 47, all of which are included in the preferred embodiment of the invention. The drill block 31 is supported in a horizontal plane at the loading station 41. As will be better understood from the following description of FIGS. 9–11, the drill block 31 is moved in the column direction over a slot 49 by a feed pneumatic actuator. Since the direction of movement of the drill block 31 is into and out of the plane of FIG. 2, the feed pneumatic actuator is not shown in FIG. 2.

As each partially or fully occupied row of the drill block reaches the slot 49, drill block movement halts because the lower end of the drills drop into the slot and impinge on the leading edge of the slot. The pressure applied to the feed pneumatic actuator is relaxed when this condition is sensed so that the drills are free to drop into a turn-over tube 51 located beneath the slot 49, as the turn-over tube is sequentially positioned between the drills in the slot in the manner hereinafter described.

Prior to receipt of a drill, the turn-over tube 51 is vertical and moved back and forth in the row direction by a turn-over tube hydraulic actuator 53, as illustrated by the arrow 54. As will be better understood from the following description, preferably, the turn-over tube hydraulic actuator 53 is part of an air-over-oil system. The turn-over tube hydraulic actuator moves the turn-over tube 51 back and forth beneath the slot 49 into which the adapter shank 37 of the drills 35 drop. A slide mounted in the slot 49 includes a single vertical hole that is aligned with the open top of the turn-over tube. Thus, when the turn-over tube 51 reaches a position occupied by a drill, the drill drops into the turn-over tube.

The dropping of a drill into the turn-over tube 51 is detected by a first proximity sensor denoted PX1, mounted atop the turn-over tube. The bottoming of the drill in the turn-over tube 51 is sensed by a second proximity sensor denoted PX2. The detection of a drill entering the turn-over tube by PX1 causes row movement of the turn-over tube beneath the feed tray 31 to immediately halt. The detection of a drill reaching the bottom of the turn-over tube 51 by PX2 causes the actuation of a turn-over tube rotation pneumatic actuator 57, if downstream mechanisms are ready to receive the drill. Actuation causes the turn-over tube 51 to be rotated, as illustrated by the arrow 56, from a vertical position to an inclined position in alignment with the upper end of an inclined channel 59, which forms part of the measuring station 43. The inclination of the turn-over tube 51 and the channel 59 is such that the drill slides out of the turn-over tube and down the channel. After the drill leaves the turn-over tube 51 and passes a third proximity sensor denoted PX3 (which forms part of a hereinafter described length measuring assembly 65), the turn-over tube rotation pneumatic actuator 57 returns the turn-over tube to its vertical position.

Located downstream of the drill receiving end of the channel 59 is a movable stop 61. The movable stop 61 is moved by a stop pneumatic actuator 63 between a normal extended position whereat the stop blocks the channel 59 and a retracted position whereat a drill is free to slide further down the channel.

Mounted near the upstream end of the channel 59 is the length measuring assembly 65. The length measuring assembly 65 includes a length pneumatic actuator 67, a length linear potentiometer 69 and the third proximity detector denoted PX3. The length pneumatic actuator 67 and the length linear potentiometer 69 are mounted in parallel above the channel 59 such that their axes of shaft movement lie parallel to one another and parallel to the longitudinal axis of the channel 59. Further, the tips of the shafts 71 and 73 of the length pneumatic actuator 67 and the length linear potentiometer 69 are connected together and support PX3. When the shafts 71 and 73 are retracted PX3 is in an upstream position. When the shafts are extended PX3 is moved downstream toward the stop 61. The back and forth movement of PX3 is represented by the stroke arrow 75 in FIG. 2.

After a drill slides down the channel 59 and impinges on the stop 61 a short delay occurs to allow the drill to settle down in the event it bounces. Thereafter, the length pneumatic actuator 67 is actuated to move PX3 toward the trailing end of the drill. When PX3 detects the trailing end of the drill movement stops and the output of the linear potentiometer 69 is read, i.e., the resistance of the length linear potentiometer is measured by a suitable electronic circuit. Then the length pneumatic actuator 69 is actuated to move PX3 away from the trailing end of the drill, back to PX3's retracted position. As will be readily appreciated from the foregoing description by those familiar with linear potentiometers, the output of the length linear potentiometer is linearly related to the distance moved by PX3 which, in turn, is linearly related to the overall length of the drill.

If the measurement of the length of the drill by the length measuring assembly 65 determines that the length is above a minimum level, the diameter of the drill is measured by a diameter measuring assembly 77. Contrariwise, if the length is below a minimum level the diameter of the drill is not measured. Rather, the drill is rejected in the manner hereinafter described.

The diameter measuring assembly 77 includes a fixed jaw 79 located on one side of the drill slightly upstream of the stop 61 so as to be aligned with the flutes of the drill. Located on the opposite side of the drill from the fixed jaw 79 is a movable jaw 81. The length of both the fixed jaw 79 and the movable jaw 81 in the direction parallel to the longitudinal axis of the drill is at least equal to the length of a complete flute twist of the drill having the longest flute twist length of the drills being sorted. Thus at least one complete flute twist is encompassed by the length dimension of the jaws.

The movable jaw 81 is moved toward and away from the fixed jaw 79 by a diameter pneumatic actuator 83. More specifically, the movable jaw is attached to the tip of the shaft 85 of the diameter pneumatic actuator 83. The shaft 85 lies orthogonal to the direction of travel of the drill down the ramp 59. Mounted in parallel alongside the diameter pneumatic actuator 83 is a linear variable differential transformer (LVDT) 87. The tip of the shaft 89 of the LVDT 87 impinges on the movable jaw 81. Consequently, the output of the LVDT is linearly related to the position of the movable jaw 81. In operation, when the diameter of a drill in the measuring station 43 is to be measured, the diameter pneumatic actuator 83 is actuated to move the movable jaw 81 toward the fixed jaw 79. When the drill is firmly gripped between the fixed and movable jaws, the output of the LVDT is read. This output is linearly related to the diameter of the drill. Thereafter, the diameter pneumatic actuator is actuated to move the movable jaw 81 away from the fixed jaw 79.

An LVDT, rather than a linear potentiometer, is used to measure drill diameter because an LVDT is substantially more accurate than a linear potentiometer. Moreover, while an LVDT is illustrated and described it is to be understood that other accurate measuring devices can be used, such as laser optical devices, for example.

After the overall length and diameter of a drill have been measured, the stop pneumatic actuator 63 is energized and the stop 61 is withdrawn from the channel 59. As a result, the drill is free to slide down the remaining length of the channel 59 into a clamp 95, which forms a portion of the deburring and flute length station 45. More specifically, the clamp 95 is mounted on the tip of the shaft 97 of a clamp feed hydraulic actuator 99. The shaft is movable in the direction of stroke arrow 101, which direction is parallel to the longitudinal axis of the channel 59 and, thus, the longitudinal axis of a drill exiting from the ramp. When the shaft 97 of the clamp feed hydraulic actuator 99 is extended, the clamp is positioned to receive a drill exiting from the ramp 59. When the clamp feed hydraulic actuator is actuated to withdraw its shaft 97, the clamp is moved in the ramp downstream direction, i.e., away from the exit end of the ramp.

Mounted parallel to the clamp feed hydraulic actuator 99 is a clamp feed linear potentiometer 100. The tip of the shaft 102 of the clamp feed linear potentiometer is also connected to the clamp 95. The clamp linear feed potentiometer 100 functions in a manner similar to the length linear potentiometer 69 to denote the position of the clamp. As a result, the output of the clamp feed linear potentiometer denotes the position of a drill gripped by the clamp 95.

After a drill leaves the channel and enters the clamp 95 the shoulder of the adapter shank is pushed against a hereinafter desribed clamp stop such that the flute end of the drill extends outwardly from the clamp in the downstream direction and the adapter shank is gripped by the jaws of the clamp. The pushing action is performed by a drill pusher assembly 103. The drill pusher assembly 103 includes a pusher pneumatic actuator 105 that pushes a pusher pin 107 into the upstream end of the clamp 95 when actuated. The pusher pin 107 is supported by a hinge bracket 109, located above the path of travel of the drill, and short and long hinge arms 111 and 113. After the drill has been pushed into the clamp 95 and the clamp closed, the clamp feed hydraulic actuator 99 is actuated to move the drill toward a deburring mechanism 115.

The deburring mechanism 115 includes a longitudinal slide 117 movable into and out of the plane of FIG. 2 by a set of pneumatic actuators not viewable in FIG. 2. The slide 117 houses a plurality of side-by-side oriented deburring bushings. Based on the diameter information developed when the drill is measured at the measuring station, the set of pneumatic actuators align the appropriate deburring bushing with the drill in the clamp 95. The alignment is such that the aperture in the deburring bushing is aligned with the longitudinal axis of the drill if the drill is straight, i.e., not bent. The deburring bushing is, of course, positioned prior to the clamp feed hydraulic actuator 99 moving the clamp 95 and, thus, the drill, toward the deburring bushing.

The aligned deburring bushing is locked in place by a bushing lock cylinder 119. The bushing lock cylinder is longitudinally moved into an aperture (formed in the slide behind each bushing) by a lock pneumatic actuator 121. The bushing lock cylinder includes a pressurized chamber which receives the end of the drill. Prior to the end of the flutes reaching the bushing the air in the chamber exits via the flutes. Thus, the air pressure in the chamber is relatively low. When the end of the flutes reach the upstream end of the bushing, pressure in the chamber rises and a hereinafter described pressure switch is actuated and causes the output of the clamp feed linear potentiometer 100 to be read. Thereafter, the clamp feed hydraulic actuator 99 is actuated in reverse and the clamp 95 is returned to the drill receiving position. Then, if the next size to be deburred is of a different diameter, the bushing lock cylinder 119 is withdrawn by the lock pneumatic actuator 121.

When in its drill receiving position the clamp 95 lies above a tray 123 forming part of the sorting station 47. The tray 123 is inclined and includes sidewalls that funnel into a narrow opening at the lower end of the tray. The tray 123 is rotatable about an axis that lies perpendicular to the bottom of the tray. The tray is rotated to discrete positions by a hereinafter described set of pneumatic actuators. As a result, the tray position determines the horizontal direction that a drill dropped into the tray takes when it slides out of the tray.

Mounted at the lower end of the rotatable tray 123 to receive a drill sliding out of the tray is a fan-shaped diverter 125. The fan-shaped diverter is inclined and hinged at its upper end so as to be movable between two inclined positions. Preferably, one of these positions is related to one type of drill, i.e., jobber, and the other is related to a second type, i.e., six inch.

The fan-shaped diverter 125 includes a plurality of channels that fan outwardly from the upper end of the diverter. A diverter pneumatic actuator 127, positioned beneath the fan-shaped diverter 125, has a shaft longitudinal axis that lies orthogonal to the bottom of the fan-shaped diverter 125. The tip of the shaft 129 of the diverter pneumatic actuator is connected to the bottom of the fan-shaped diverter 125. The actuation direction of the diverter pneumatic actuator controls the inclined position of the fan-shaped diverter 125. In the upper inclined position the channels of the fan-shaped diverter 125 direct drills received from the rotatable tray 123 into one of a plurality of upper bins 131. In the lower position the channels of the fan-shaped diverter 125 direct drills into one of a plurality of lower bins 133. Which upper or lower bin is actually selected is dependent upon which diverter channel receives the drill, which in turn is dependent upon the position of the tray 123. The measured diameter of the drill being sorted determines the position of the rotatable tray and, thus, which diverter channel receives the drill. In summary, drill type determines if the drill is to go to the upper or lower set of bins and drill diameter determines which bin in the set is to receive the drill.

As will be readily appreciated from the foregoing description of FIG. 2, the invention provides an automatic drill sorting machine that receives a mixture of drills one-at-a-time, measures the length and diameter of each drill, determines whether or not the drills are straight, cleans burrs from the drills, determines the flute length of each drill (by combining the overall length data with the data developed when the end of the drill flutes reach the deburring bushing), and sorts the drills in accordance with the information developed.

Prior to describing in detail the mechanical structure illustrated in FIG. 2, attention is directed to FIGS. 3-8, which illustrate and describe the nature and position of certain additional elements included in the preferred embodiment of the invention. In this regard, FIG. 3 is an actuator valve table that sets forth the station, reference number, function and solenoid type of each actuator control value included in the preferred embodiment of the invention, plus whether the valve is a detent type or has a spring return.

Figure 4:
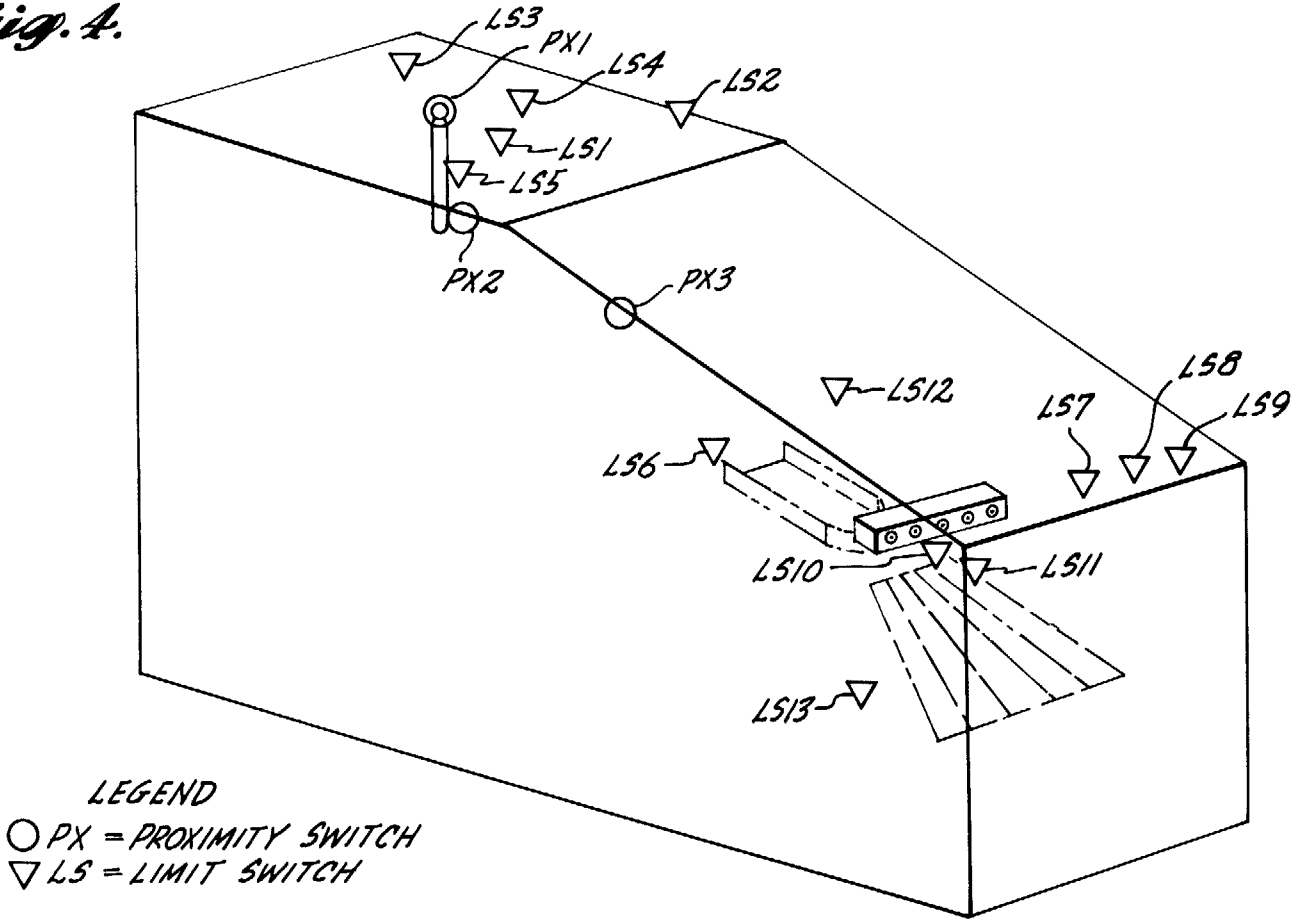
FIG. 4 is a pictorial diagram illustrating the location of proximity and limit switches included in the preferred embodiment of the invention.

The automatic drill sorting system of the invention includes sensors for sensing when certain actions take place and/or the position of the shafts of the various pneumatic and hydraulic actuators. The sensed data is fed to a control system that controls the sequence of operation of the automatic drill sorting machine. The sensors comprise a plurality of limit switches, pressure switches and proximity switches. FIG. 4 is a pictorial diagram illustrating the general location of the proximity and limit switches. FIGS. 5 and 6 are limit switch and proximity switch tables, respectively, that set forth the location, reference number and functions of the limit and proximity switches. FIG. 7 is a pressure switch table that sets forth the location, reference number and function of the pressure switches included in the preferred embodiment of the invention.

Figure 8:
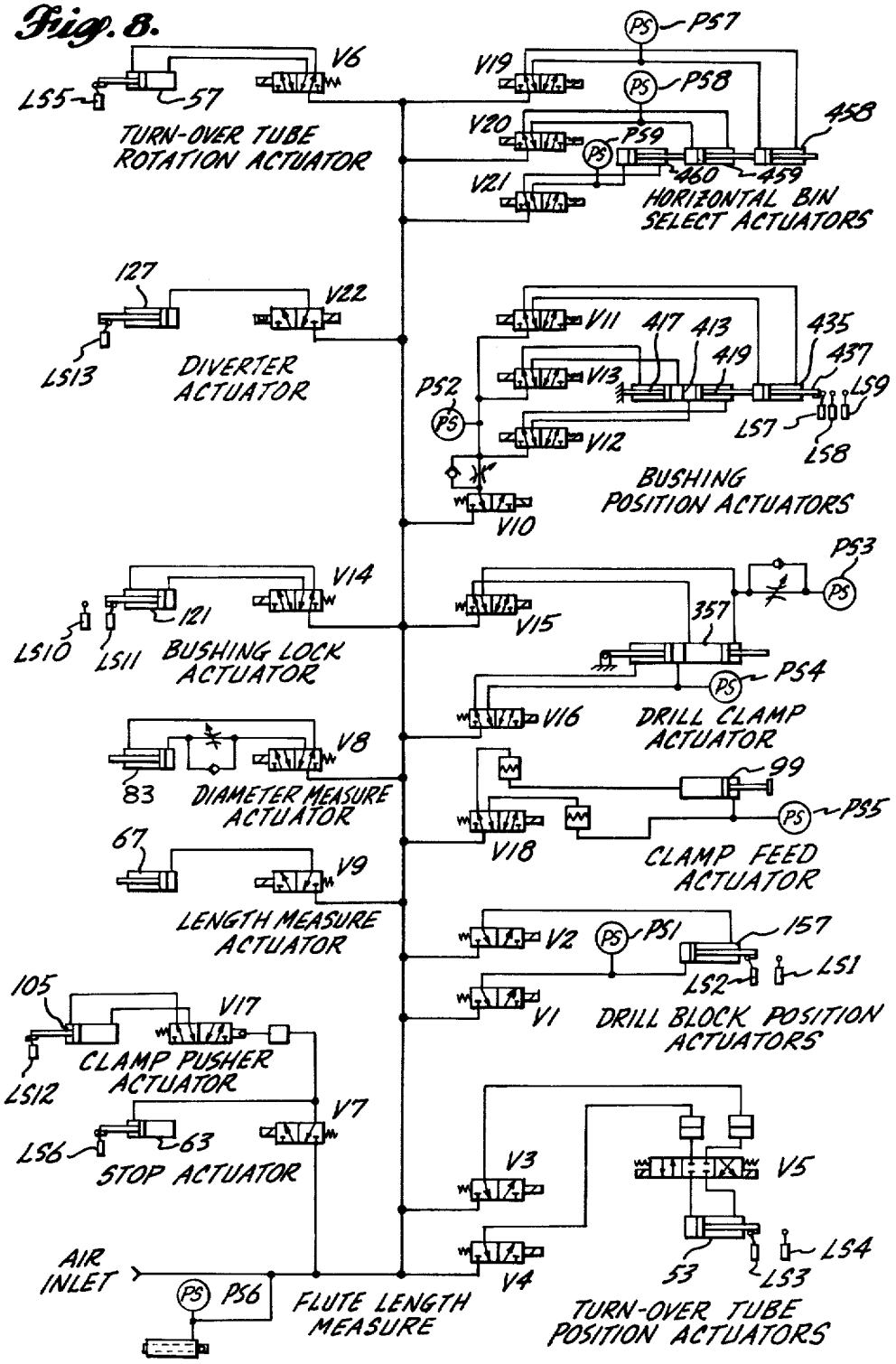
FIG. 8 is a schematic diagram of the limit switches, actuators, actuator valves, pressure switches and related elements included in the preferred embodiment of the invention.

FIG. 8 is a pneumatic/hydraulic schematic diagram illustrating the coupling of the actuator valves listed in FIG. 5 to the various pneumatic and hydraulic actuators. FIG. 8 also includes the pressure switches listed in FIG. 7 and the limit switches listed in FIG. 5.

Loading Station

Figure 9:
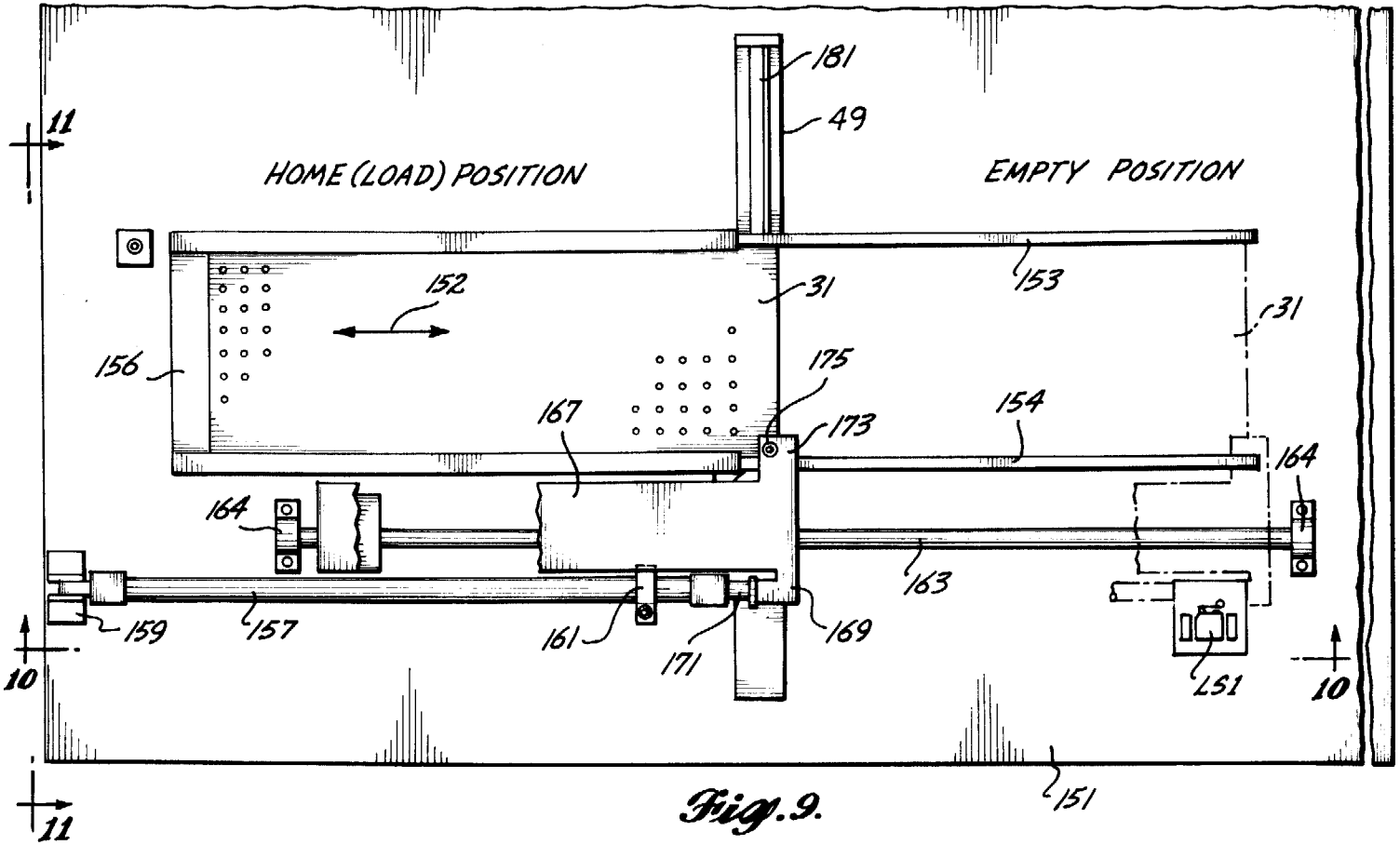
FIG. 9 is a top plan view of the loading station of the preferred embodiment of the invention.
Figure 10:
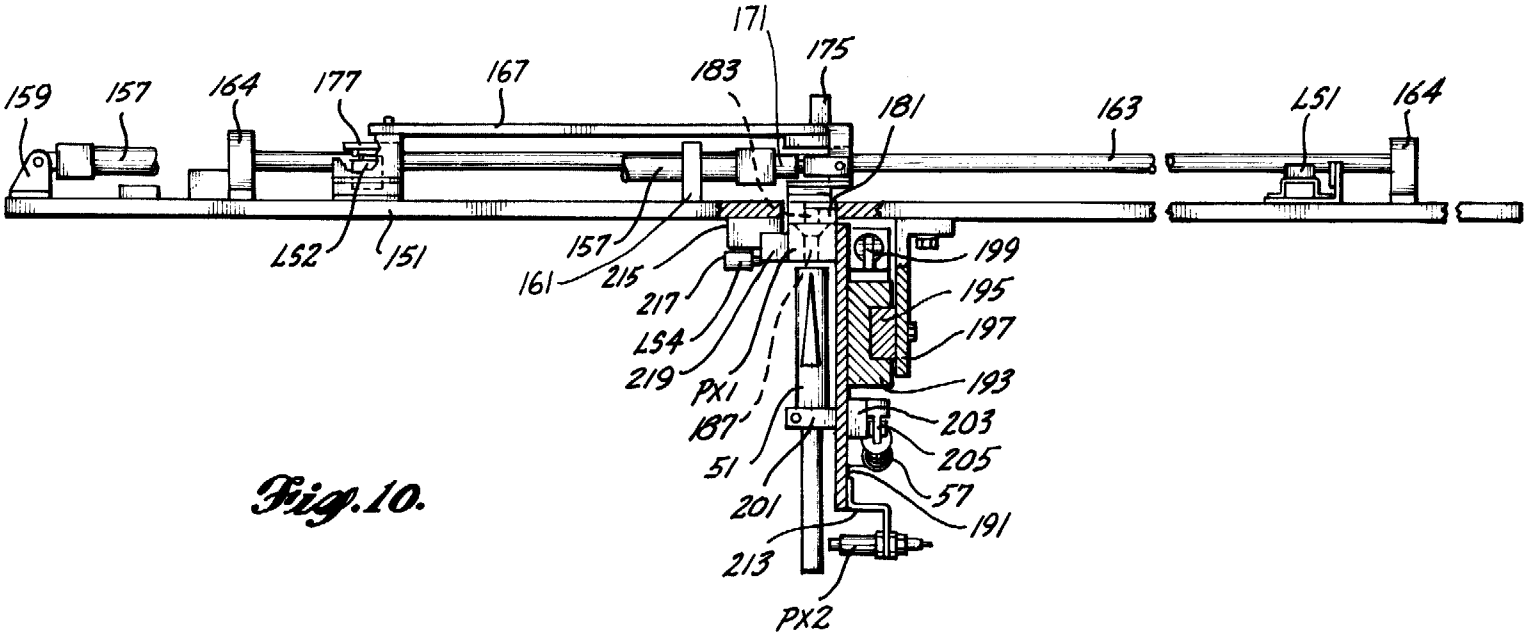
FIG. 10 is a side elevational view, partially in section, of the loading station illustrated in FIG. 9.
Figure 11:
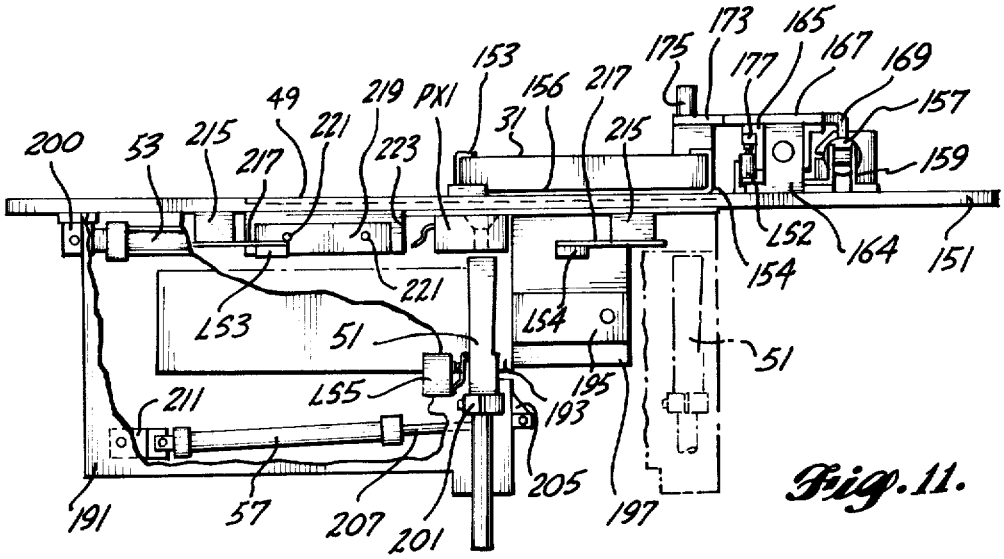
FIG. 11 is an end elevational view, partially in section, of the loading station illustrated in FIG. 9.

FIGS. 9, 10 and 11 illustrate in detail a loading station 41 suitable for use in the preferred embodiment of the invention. In this regard, while the major operative elements of the loading station are shown in detail, for purposes of clarity of illustration, as with the FIGURES illustrating the other stations in detail, except where necessary, the support structure utilized to support the loading station mechanism is not illustrated in FIGS. 9-11. It is to be understood, of course, that all required support structure must be included in an actual embodiment of the invention. Similarly, nuts and bolts and other attachment items are generally not illustrated in FIGS. 9-11, or the FIGURES illustrating the other stations in detail.

As previously described, the drills to be sorted are housed in a drill block 31 supported in a horizontal plane. In FIGS. 9-11 the drill block 31 is housed in a sheet metal tray 156 that in turn is supported by a horizontal sheet which may form the top 151 of a cabinet housing the automatic drill deburring and sorting machine. The sheet metal tray 156 has a U-shaped crossectional configuration that covers the bottom and sides of the drill block. At least one end of the sheet metal tray 156 is open. The drill block is slid out of the open end of the sheet metal tray in the manner hereinafter described. The sheet metal tray enclosure prevents drills from dropping out of the bottom of the drill block during transportation.

The path of travel of the drill block in the column direction (illustrated by the arrow 152) is defined by a pair of rectangular guides 153 and 154 mounted atop the top 151. The starting end of the path of travel is defined as the home or load end. The other end of the feed tray path of travel is defined as the empty end. As previously described, as the feed tray is moved in the column direction in the manner herein described, the rows of drills drop into a slot 49 located about where the guides 153 and 154 begin.

Also, mounted atop the top 151 is a feed pneumatic actuator 157. The feed pneumatic actuator 157 is positioned such that its longitudinal axis lies parallel to the guides 153 and 154. The closed end of the cylinder of the pneumatic actuator is attached to the top 151 via a clevis 159 located beyond the home end of the path of travel of the feed tray. The other end of the actuator cylinder is supported by a bracket 161 attached to the top 151. Mounted between the feed pneumatic actuator 157 and the nearest guide 154 is a guide rod 163. The guide rod 163 is supported by a pair of end brackets 164 such that its longitudinal axis lies parallel to the longitudinal axis of the feed pneumatic actuator 157. The guide rod 163 supports a pair of spaced apart T-shaped slides 165 that in turn horizontally support an elongate plate 167. The elongate plate 167 includes an outwardly extending arm 169 on the end remote from the clevice attached end of the feed pneumatic actuator 157. The outwardly extending arm 169 is attached to the tip of the shaft 171 of the feed pneumatic actuator 157. The opposite corner of the elongate plate 167, on the same end, includes an inwardly extending arm 173 that overlies the path of travel of the drill block 31, near the nearest guide 154. The inwardly extending arm 173 is connected to the adjacent trailing corner of the drill block 31 by a suitable attachment mechanism that includes a vertical arm positioned behind the trailing edge of the drill block 31 and a pin or bolt 175 that extends into an aperture in the drill block.

As will be readily appreciated at this point, when the feed pneumatic actuator 157 is actuated, the elongate plate 167 is slid in one direction or the other, depending upon the direction of actuation of the feed pneumatic actuator 157. Since the elongate plate is attached to the drill block 31, the drill block is also slid in one direction or the other when the elongate plate is moved. In the forward direction, which is defined as the direction of movement when the shaft 171 of the feed pneumatic actuator 157 is being extended from the actuator cylinder, the drill block 31 is moved from the home end of its path of travel toward the empty end. As such movement occurs drills located in the holes in the drill block 31 drop into the slot 99, as the partially or fully occupied rows reach a position above the slot. As each partially or fully occupied row reaches this position and the drills drop down into the slot, they impinge on a slide 181 illustrated best in FIG. 10 and hereinafter described in detail. The drills only drop a short distance and continued drill block movement causes the dropped drills to impinge on the lip of a hereinafter described L-shaped slide 181. This impingement causes a pressure rise in the air line to the feed pneumatic actuator 157, which actuates PS1. The actuation of PS1 causes the forward actuation pressure to temporarily cease, whereby the impingement pressure of the drills against the upstream edge of the slots terminates. As a result, the drills in the slot are free to drop into the turn-over tube 51 in the manner herein described. After the row of drills in the slot have all dropped into the turn-over tube, pressure is reapplied to the feed pneumatic actuator 157, whereby the drill block 31 is again moved forward, until the next occupied row of drills reaches a position above the slot, the drills in the row drop into the slot and drill block motion again stops. After all of the drills in the drill block 31 have dropped into the slot and been loaded into the automatic deburring and sorting machine, the drill block 31 is slid to its empty position, at which position the shaft 171 is fully extended. When the drill block reaches its empty position LS1 is actuated by the fully extended shaft 171 of the feed pneumatic actuator 157. When LS1 is actuated the feed pneumatic actuator is reversed and the drill block is returned to its home position. As illustrated in phantom in FIG. 10, when this position is reachhed LS2 is actuated by an arm 177 extending downwardly from the plate 167. After the drill block is returned to the home position, the now empty drill block and its associated sheet metal tray 156 are removed and replaced with a full drill block/tray assembly.

As best illustrated in FIG. 10, the slide 181 mounted in the slot 49 has an L-shaped cross-sectional configuration. The vertical leg of the L-shaped slide lies along the upstream side of the slot 49. The slide 181 includes a single hole 183 in its horizontal leg located where the horizontal leg meets the vertical leg. Attached to the slide, beneath the hole 183, a PX1. PX1 has a central aperture 187 that is aligned with the hole 183 in the slide 181. PX1 and the slide are affixed to a flat, vertically oriented support plate 191, as best illustrated in FIG. 10. The support plate 191 in turn is attached to an elongate C-shaped slide 193 whose aperture surrounds a horizontal slide rail 195. Preferably, the C-shaped slide 193 and the slide rail 195 are parts of a precision ball slide assembly. The slide rail 195 is attached to the downwardly projecting leg of an L-shaped bracket 197 attached to the bottom of the cabinet top 151. The longitudinal axes of the C-shaped slide 193, the slide rail 195 and the L-shaped bracket 197 are all parallel to the longitudinal axis of the slot 49. Mounted atop the C-shaped slide 193 is a bracket 199 connected to the tip of the shaft of the turn-over tube hydraulic actuator 53. The other end of the cylinder of the turn-over tube hydraulic actuator 53 is attached via a clevis 200 to the bottom of the cabinet top 151. The positioning axis of the turn-over tube hydraulic actuator 53 is parallel to the longitudinal axis of the slot 49.

As will be readily appreciated by those skilled in the art and others from the foregoing description and FIGS. 10 and 11, when the turn-over tube hydraulic actuator 53 is actuated to move its shaft back and forth, the C-shaped slide 193 is moved back and forth in a direction parallel to the longitudinal axis of the slot 49.

Since the support plate 191, PX1 and the slide 181 are affixed to the C-shaped slide 193, when the C-shaped slide 193 is moved back and forth the latter elements are also moved back and forth whereby the hole 183 in the L-shaped slide 181 and the aperture 187 in PX1 are moved back and forth.

Rotatably mounted on the support plate 191 beneath the aperture in PX1 is the turn-over tube 51. More specifically, the turn-over tube 51 has an open upper end adapted to receive a drill when the turn-over tube is vertical. The other end of the turn-over tube is closed. A collar 201 surrounds a central region of the turn-over tube 51. The collar includes a radial shaft that extends through an aperture in the support plate 191 into the inner race in a bearing 203. The outer race of the bearing 203 is affixed to the support plate 191. Hence, the collar shaft is rotatably mounted. The end of the shaft extends beyond the bearing 203 and is attached to one end of a crank 205. The other end of the crank 205 is connected to the tip of the shaft 207 of the turn-over tube pneumatic actuator 57. The other end of the cylinder of the turn-over tube pneumatic actuator 57 is connected to the support plate 191 by a suitable bracket 211. The position of the turn-over tube pneumatic actuator is such that when it is actuated to pull its extended shaft 207 inwardly, the turn-over tube 51 is rotated from its vertical position illustrated in FIGS. 10 and 11 to its inclined position about the axis of the collar shaft. When the turn-over tube pneumatic actuator 57 is actuated to extend its shaft 207, the turn-over tube 51 is returned to its vertical position.

Supported by a bracket 213 attached to the bottom of the vertical plate 191 is PX2. More specifically, as best illustrated in FIG. 10, the bracket 213 supports PX2 such that PX2 is located near the bottom of the turn-over tube 51 when the turn-over tube is in its vertical position.

Attached to the bottom of the cabinet top 151, at either end of the path of travel of the support plate 191 are support blocks 215. Affixed to the bottom of each of the support blocks 215 is a small plate 217. The small plates 217 extend toward each other from the blocks 215. Attached to the lower surface of one of the small plates 217 is LS3. LS4 is attached to the lower surface of the other small plate. LS3 and LS4 are actuated by a block 219 that is attached to the support plate 191 by screws 221, as illustrated in FIG. 11. Finally, as also illustrated in FIG. 11, LS5 is mounted on the support plate 191 so as to be actuated by a cam mounted on the shaft of the collar 201, when the turn-over tube 51 is vertical.

Figure 14:
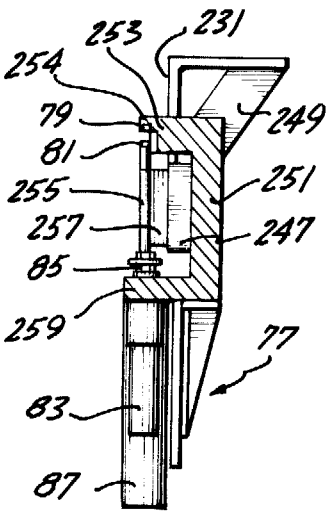
FIG. 14 is an end elevational view of the measuring station illustrated in FIG. 12.
Figure 12:
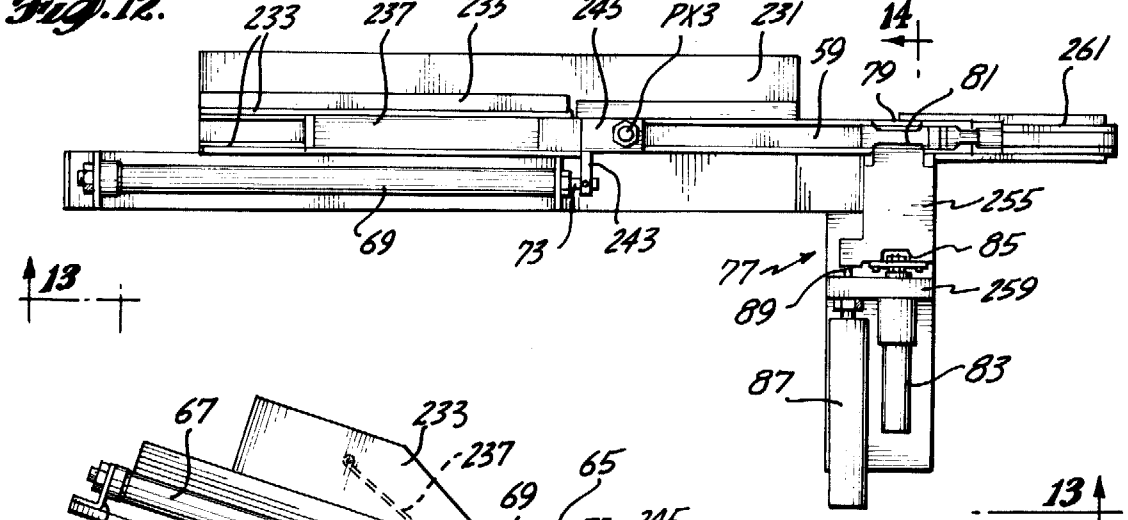
FIG. 12 is a top plan view of the measuring station of the preferred embodiment of the invention.
Figure 13:
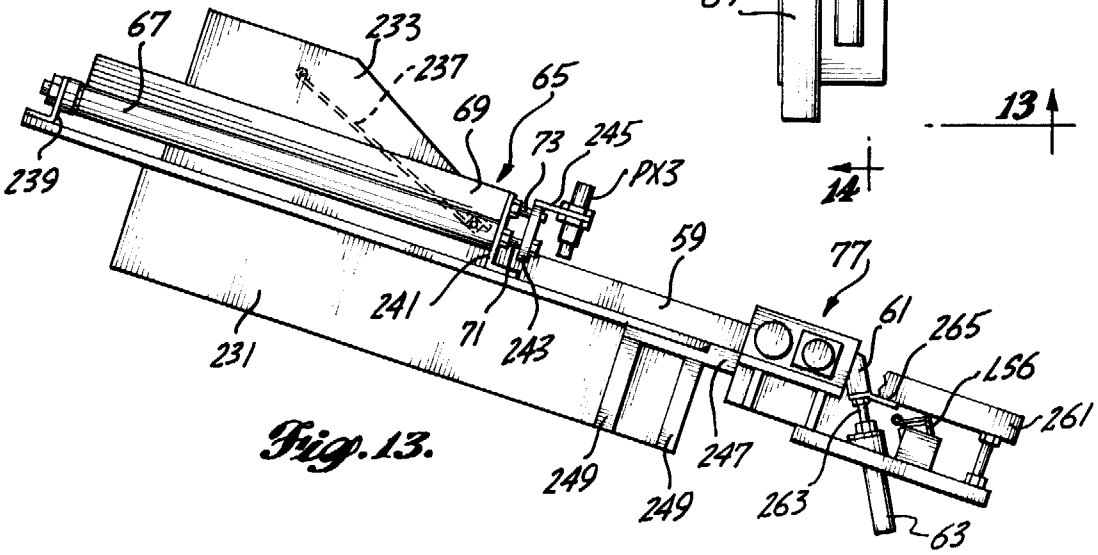
FIG. 13 is a side elevational view of the measuring station illustrated in FIG. 12.

In operation, initially, the drill block 31 is in its home position, which is illustrated in FIG. 9, and its holes 33 are partially or fully filled with drills. The block moves from the position shown to the phantom line position, i.e., from left to right. When the first row of apertures containing one or more drills reach a position above the L-shaped slide 181, the drills drop. As a result, drill block movement stops and pressure builds up in the air line feeding the feed pneumatic actuator 157. This pressure actuates PS1 and causes the pressure of the air applied to the feed pneumatic actuator to drop, whereby the pressure between the leading edge of the drills and the vertical leg of the slide 181 ends. Thereafter, the support plate 191 is moved from right to left, or left to right, depending upon its last position. As the support plate is moved, drills sequentially drop through the hole 183 in the slide plate 181, PX1 and into the turn-over tube 51. When a drill enters the turn-over tube 51, the step feed motion produced by the turn-over tube hydraulic actuator 53 immediately terminates. (As illustrated in FIG. 8, the turn-over tube hydraulic actuator is part of an air-over-oil system, which is included to provide the desired immediate stop action.) When the drill reaches the bottom of the turn-over tube 51, it is sensed by PX2. When PX2 senses the presence of a drill and other required conditions are met, the turn-over tube pneumatic actuator 57 is actuated to rotate the turn-over tube from its vertical position to its inclined position. As a result, the drill slides out of the turn-over tube and down the ramp 59 of the measuring station 43, which is illustrated in FIGS. 12–14 and next described. The turn-over tube mchanism is supported and guided by the support plate 191, the C-shaped slide 193, the slide rail 195 and the L-shaped bracket 197.

Measuring Station

The channel 59 of the measuring station 43 that receives the drill from the turn-over tube 51 is mounted atop the inclined leg of a right angle support 231. Located on either side of the receiving end of the channel 59 are a pair of vertical plates 233. As illustrated in FIG. 12, the plates 233 may include orthogonal flanges 235 along their lower ends so that they can be attached to the inclined leg of the right angle support 231. In any event, when the turn-over tube is rotated its open end is guided by the vertical plates 233, toward the upstream end of the channel 59.

Mounted between the plates 233 is an arm 237 that prevents a drill from bouncing out of the channel 59. The upper end of the arm 237 is pinned near the upstream end of the vertical plates 233. The arm converges toward the channel 59; and, the lower end of the arm 237 (as illustrated in FIG. 13) lies near the downstream ends of the length pneumatic actuator 67 and the length linear potentiometer 69.

As previously described with respect to FIG. 2, the longitudinal axes of the length pneumatic actuator 67 and the length linear potentiometer 69 lie parallel to the longitudinal axis of the channel 59. The cylinder of the length pneumatic actuator 67 is supported by end brackets 239 and 241. The downstream end bracket 241 also supports the downstream end of the housing of the length linear potentiometer 69. The tips of the shafts of the length pneumtic actuator and potentiometer 71 and 73, respectively, are affixed to a small bracket 243. The small bracket 243 includes an arm 245 that supports PX3 such that PX3 lies above the channel 59, as best illustrated in FIGS. 12 and 13.

Extending outwardly from the downstream end of the right angle support 231 is an arm 247. The arm 247 is undercut at its upstream end so that its top is coplanar with the inclined leg of the right angle support 231 while a flange extends beneath the inclined leg. A pair of gussets 249 extend between the flange of the arm 247 and the vertical leg of the right angle support 231.

Attached to the downstream end of the bottom of the arm 247 is a U-shaped bracket 251. More specifically, as shown in FIG. 14, the upper surface of the cross member of the U-shaped bracket 251 is attached to the bottom surface of the arm 247 such that the legs of the U-shaped bracket 251 lie on either side of the arm 247. One of the legs 253 of the U-shaped bracket 251 intersects leg channel 59. The intersecting leg includes a vertical lip 254 that forms the fixed jaw 79 of the diameter measuring assembly 77. More specifically, the lip forms one wall of the channel in the region where the U-shaped bracket 251 intersects the channel. The movable jaw 81 is formed by one edge of a plate 255 supported by a slide block 257 mounted atop the arm 247. The edge of the plate 255 opposed to the jaw edge is connected to the shaft 85 of the diameter pneumatic actuator 83, which is mounted in the other leg 259 of the U-shaped bracket 251. The LVDT 87 is also mounted in the other leg 259. The shaft 89 of the LVDT 87 is spring loaded and impinges on a projection forming a portion of the plate 255.

Located downstream of the diameter measuring assembly 77 is a further area 261 of the channel 59. The further channel area 261 includes a bottom aperture through which the stop 61 extends. As previously discussed, the stop 61 is mounted on the tip of the shaft 263 of the stop pneumatic actuator 63. The stop is movable between a normal position at which the shaft 263 is extended. In its normal position the stop 61 prevents a drill from sliding into the further channel area 261. When in its other position the shaft is retracted and the stop 61 is positioned such that a drill is free to slide into the further channel area 261. Attached to the shaft 263 of the stop pneumatic actuator 63 is an arm 265 that contacts the actuating element of LS6 when the stop 61 is retracted.

In operation, as previously described with respect to FIG. 2, normally, the stop 61 is in its normal position, whereby the channel 59 is blocked. As a result, a drill entering the channel 59 stops when its leading edge or tip impinges on the stop 61. Thereafter, the length and diameter of the drill are measured by the length and diameter measuring assemblies 65 and 77. The diameter is measured by actuating the diameter pneumatic actuator 83, which causes the plate 255 and, thus, the movable jaw 81 to move toward the fixed jaw 79. When the movable jaw 81 reaches a position such that the shaft of the drill flute is pressed against the fixed jaw 79, the LVDT 85 is read, which reading is linearly related to the diameter of the drill being measured. At approximately the same time, the length pneumatic actuator 67 is actuated to move PX3 toward the trailing edge of the drill. When PX3 senses the trailing edge of the drill, the length linear potentiometer 69 is read, which reading is linearly related to the length of the drill. After the drill diameter and length readings are made, the diameter and length pneumatic actuators are actuated to return to their quiescent or start positions. Thereafter, the stop pneumatic actuator 63 is actuated to retract stop 61 and the drill leaves the measuring station. Retraction of the stop 61 is sensed by LS6.

Drill Pusher Assembly

Figure 17:
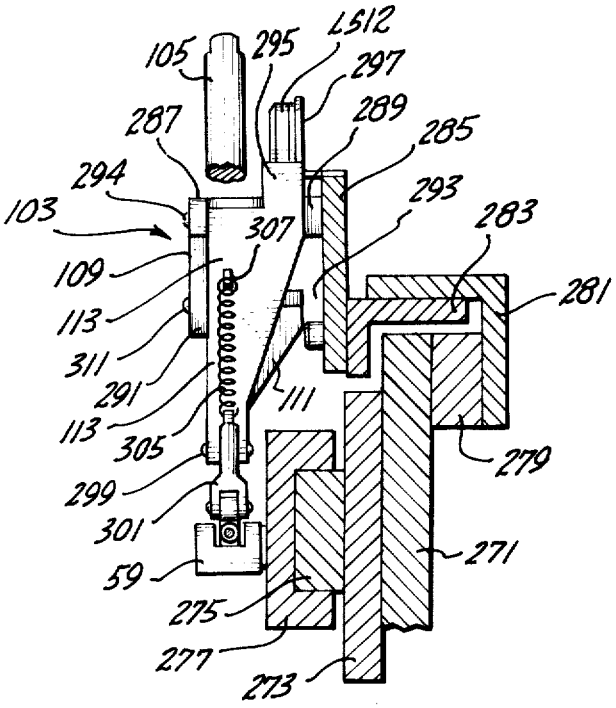
FIG. 17 is a cross-sectional view along line 17—17 of FIG. 15.
Figure 16:
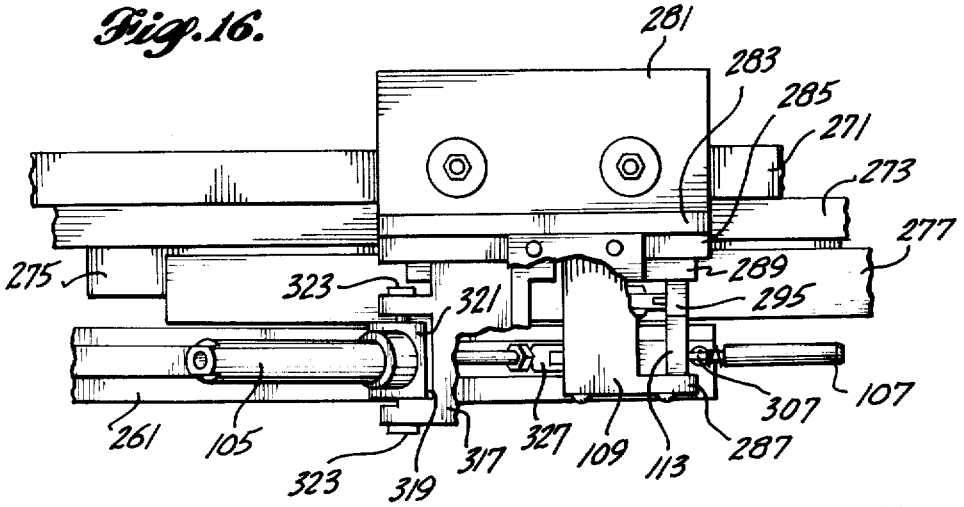
FIG. 16 is a top plan view of the clamp pusher mechanism illustrated in FIG. 15.
Figure 15:
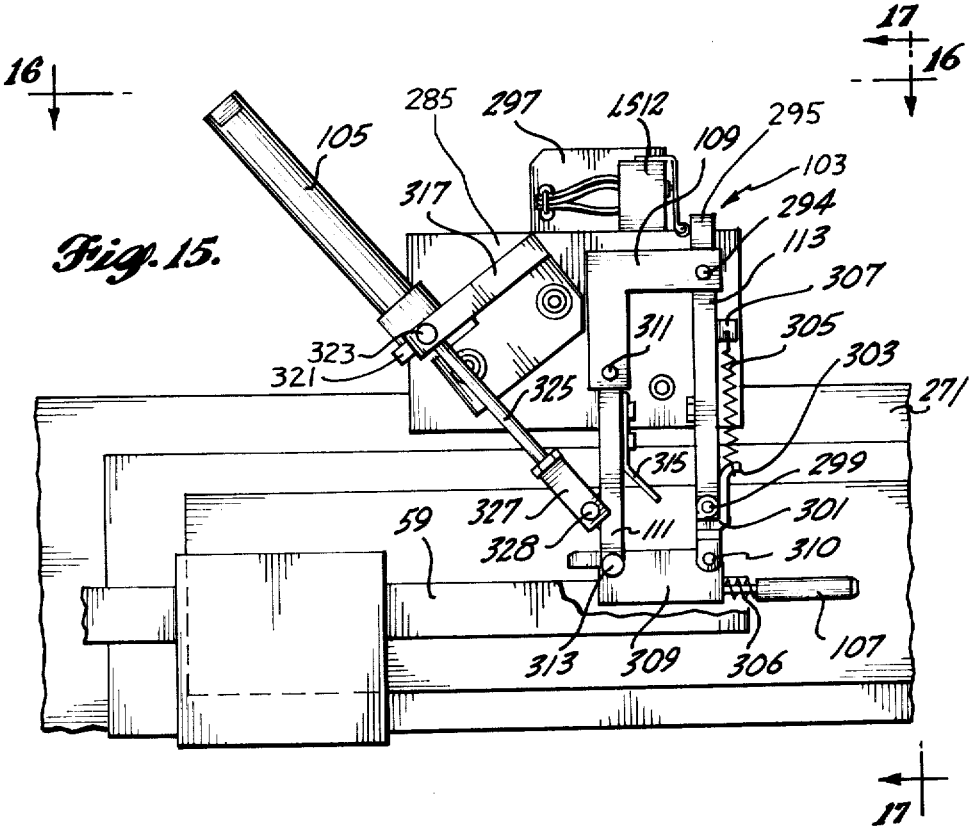
FIG. 15 is a side elevational view of a clamp pusher mechanism included in the preferred embodiment of the invention.

FIGS. 15, 16 and 17 illustrate in detail a drill pusher assembly 103 suitable for pushing a drill into the clamp 95 after the stop 61 is retracted and the drill leaves the measuring station 43. The drill pusher assembly 103 is mounted on a vertical support plate 271 that also supports an inclined guide mechanism on which the hereinafter described drill clamp mechanism is mounted for linear movement. Since the inclined guide mechanism is illustrated in FIGS. 15, 16 and 17, and since its nature and location will assist in the understanding of the nature, location and operation of the drill pusher assembly, the guide mechanism is briefly described first. The inclined guide mechanism comprises an elongate plate 273 mounted on one face of the vertical support plate 271. Mounted on the opposite surface of the elongate plate 273 is a slide rail 275. A C-shaped precision slide 277 is supported by the slide rail 275. The clamp 95 is mounted on the vertical face of the C-shaped slide 277 in the manner illustrated in FIGS. 18–20 and hereinafter described.

The drill pusher assembly includes a support subassembly, best seen in FIG. 17, that includes a bar 279, two angles 281 and 283 and plate 285. The bar 279 is mounted on the opposite side of the vertical support plate 271 from the side supporting the elongate plate 273. The bar 279 is located near the top of the vertical support plate 271. Mounted on the opposite side of the bar 279 from the vertical support plate 271 is the inside face of the vertical leg of the first angle 281. The other leg of the first angle 281 overlies the bar 279 and the top of the vertical support plate 271. Attached to the bottom of the other leg of the first angle 281 is the leg of the second angle 283. The other or vertical leg of the second angle 283 projects downwardly and supports, on its outer surface, the plate 285. The other vertical face of the plate, in turn, supports the hinge bracket 109 illustrated in FIG. 2 and briefly heretofore described.

The hinge bracket 109 comprises a thick L-shaped bracket mounted on the plate 285 such that one leg lies above and is parallel to the slide rail 275 and the C-shaped slide 277. The central region near the outer end of this leg is removed, whereby the leg includes a first pair of spaced apart arms 287 and 289 (FIG. 16). The other leg of the L-shaped hinge bracket 109 lies orthogonal to the first leg and transverse to the drill path of travel down the channel 59. The central region near the outer end of this leg is also removed, whereby this leg also includes a second pair of spaced apart arms 291 and 293 (FIG. 17).

Rotatably pinned between the outer ends of the first pair of spaced apart arms 287 and 289 by a pin 294 is the long hinge arm 113. The long hinge arm 113 includes an upward projection 295 adapted to impinge on the operative element of LS12 when the long arm 113 is in a vertical position. In this regard, LS12 is supported by a bracket 297 mounted atop the plate 285. One of the edges of the long hinge arm converges toward the other edge in the region below where the long hinge arm is pinned to the hinge bracket. The long hinge arm terminates in a yoke that lies above the channel 59. Rotatably pinned to the legs of the yoke by a pin 299 is a link 301. The link 301 includes an upwardly projecting arm that normally impinges on the downstream face of the long hinge arm 113. The upper end of the arm includes a hook 303 that is connected via a coil spring 305 to a pin 307 extending outwardly from the downstream face of the long hinge arm 113. The lower end of the link 301 includes a yoke between the arms of which the upper leading corner of a shoe block 309 is rotatably pinned by a pin 310.

The upper end of the short hinge arm 111 is rotatably pinned between the second pair of spaced apart arms 291 and 293 of the hinge bracket 109 by a pin 311. One of the edges of the short hinge arm 111 converges toward the other end in the region below where the short hinge arm 111 is pinned to the hinge bracket 109. The lower end of the short hinge arm 111 terminates in a yoke that lies above the channel 59 and is pinned to the upper trailing corner of the shoe block 309 by a pin 313. The pusher pin 107 is attached to and projects outwardly from the downstream end of the shoe block 309.

Attached to the downstream face of the short hinge arm 111 is an inclined stop leaf 315. When the pusher pin 107 is pulled to the retracted position illustrated in FIG. 2, the stop leaf 315 impinges on the long hinge arm 113 to stop the movement of the long hinge arm 113 and allow link 301 to rotate and pull pusher pin 107 up and out of the way.

One leg of an L-shaped actuator support bracket 317 is mounted on the plate 285 upstream of the hinge bracket 109, such that the other arm overlies the channel 59. The outwardly projecting arm of the actuator support bracket 317 includes an aperture 319 within which the shaft end of the cylinder of the pusher pneumatic actuator 105 is mounted. More specifically, a collar 321 surrounds the end of the cylinder. The collar is rotatably mounted between the arms of the aperture 319 by a pair of pins 323 that lie along a common horizontal axis such that the shaft 325 of the pusher pneumatic cylinder 105 projects downwardly toward the upstream face of the short hinge arm 111. The tip of the shaft 325 is rotatably attached to the upstream face of the short hinge arm 111 via a clevis 327 and a pin 328.

In operation, normally, the pusher pneumatic actuator 105 is actuated such that its shaft 325 is retracted. As a result, the pusher pin 107 lies above the path of travel of a drill sliding down the channel 59. After a drill has slid down the channel and entered the clamp 95 in the manner hereinafter described, the pusher pneumatic actuator 105 is actuated and extends its shaft. The extension of the shaft 325 rotates the lower end of the short hinge arm 111, the lower end of the long hinge arm 113 and, thus, the shoe 309 downwardly and forwardly. As a result, the pusher pin 107 is rotated into the channel 59. The rotation is such that the tip of the pusher pin 107 impinges on the trailing end of a drill in the clamp 95. Pressure on the trailing end of the drill produced by the pusher pneumatic actuator and conveyed to the drill via the pusher pin pushes the drill fully into the clamp. The desired final position is achieved when the long hinge arm lies orthogonal to the channel 59. When this position is achieved, LS12 is actuated to indicate that the drill is fully in the clamp 95. Thereafter, pusher pneumatic actuator 105 is actuated to retract the pusher pin 107. A coil spring 306 wrapped around the shaft of the pusher pin 107 (which is slidably mounted in the shoe block 309) provides a tolerance mechanism that compensates for slight differences in the length of the drill adapter shanks.

Deburring and Flute Length Station

FIGS. 18-21 illustrate a deburring and flute length station 45 suitable for use in the preferred embodiment of the invention. The deburring and flute length station generally comprises two main subassemblies—a clamp subassembly 331 and a deburring subassembly 333. The clamp subassembly 331 includes the clamp 95 that receives drills from the channel 59. After receiving a drill the clamp moves the drill toward the deburring subassembly. The deburring subassembly includes a plurality of deburring bushings and a mechanism for positioning the appropriate bushing in line with a drill held in the clamp based on the diameter information developed at the measuring station 43.

Figures 18, 19:
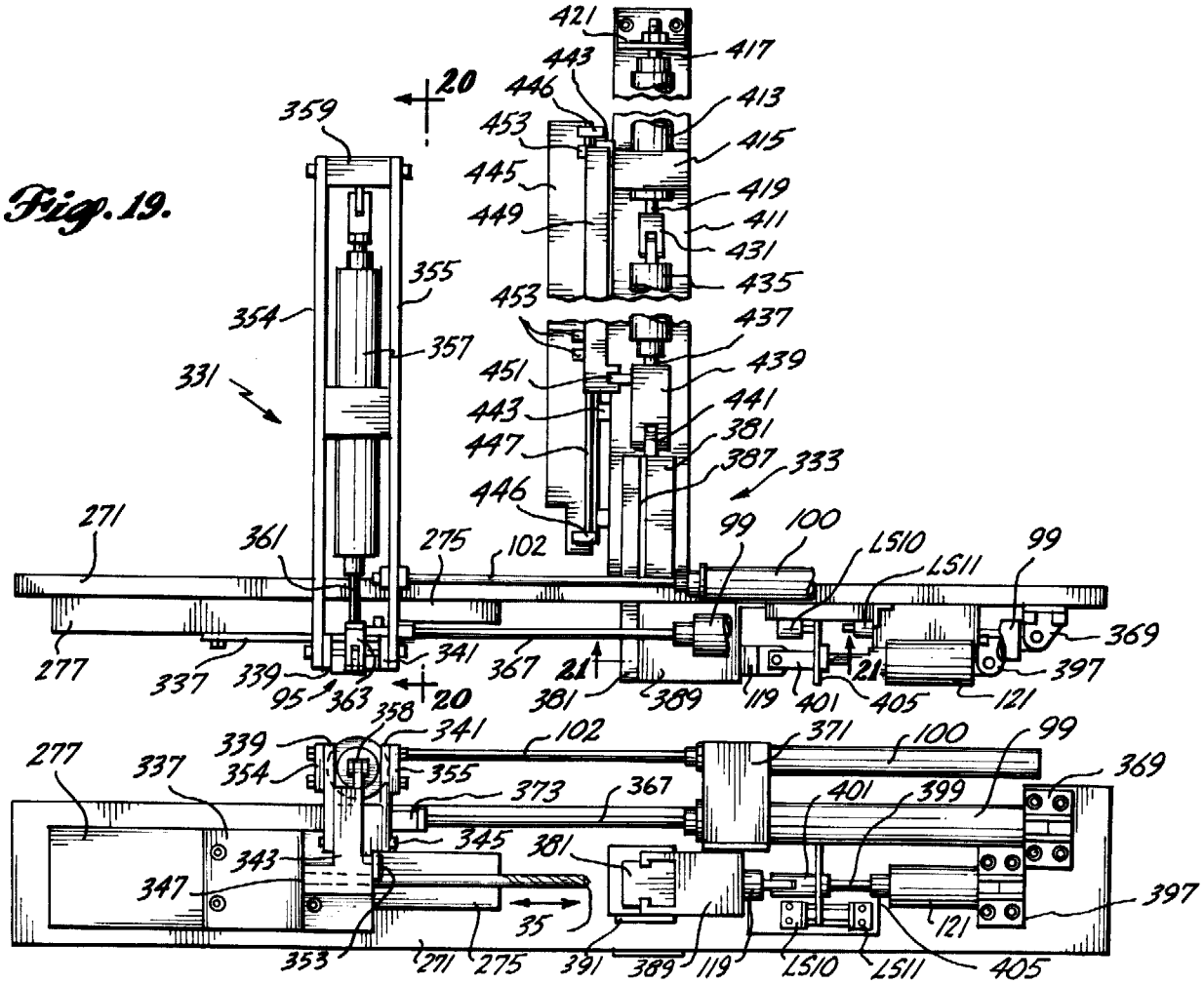
FIG. 18 is a side elevational view of a deburring and flute length station included in the preferred embodiment of the invention.
FIG. 19 is a top plan view of the deburring and flute length station illustrated in FIG. 18.
Figure 20:
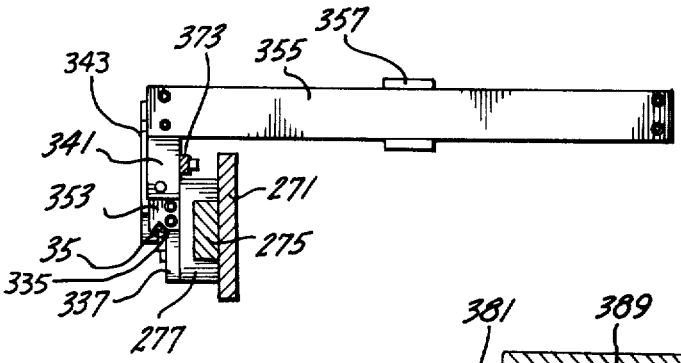
FIG. 20 is a cross-sectional view along line 20—20 of FIG. 19.

As best seen in FIGS. 18, 19 and 20 the clamp 95 includes a fixed jaw 335 formed by part of a jaw bracket 337 mounted on the vertical face of the C-shaped precision slide 277 supported by the slide rail 275 which, in turn, is mounted on the vertical support plate 271—all of which were illustrated in FIGS. 15-17 and heretofore described. The jaw bracket 337 includes an integral pair of upstanding arms 339 and 341. Rotatably mounted between the pair of upstanding arms 339 and 341 is a movable jaw 343. More specifically, the movable jaw 343 is rotatably pinned to the base of the integral upstanding arms 339 and 341 by a pin 345. The movable jaw is positioned to coact with the fixed jaw. In this regard, between the fixed and movable jaw is a V-shaped jaw aperture 347 adapted to receive a drill 35 after it leaves the channel 59. Specifically, the fixed jaw has a V-shaped slot and the movable jaw is flat. The adapter shank of a drill is clamped in the V-shaped slot by the movable flat jaw. The distance across the V-shaped jaw aperture is slightly more than the diameter of the adapter shank of a quick change drill when the clamp is in the feed position. In this regard, the movable jaw has three positions—a partially open feed position for receiving drills; a clamped position for tightly holding drills; and, an open position for dropping drills. The positions are indicated by the states of PS3 and PS4.

A stop 353 mounted at the downstream end of the jaw aperture 347 prevents the drill pusher assembly heretofore described from pushing the adapter shank end of a quick change drill out of the jaw aperture 347. In this regard, the stop 353 has a V-shaped lower periphery against which the shoulder of the adapter shank is pressed. The opening in the "V" allows the flute end of the drill to emerge from the clamp 95.

Affixed to, and projecting orthogonally outwardly from, the upwardly extending arms 339 and 341 are a pair of actuator support plates 354 and 355. The plates are positioned so as to overlie the C-shaped guide 277 and the vertical support plate 271. Positioned between the plates is a jaw pneumatic actuator 347. The cylinder of the jaw pneumatic actuator 357 is attached to a cross member 359 mounted between the outer ends of the actuator support plates 354 and 355. The tip of the shaft 361 of the jaw pneumatic actuator 357 is connected by a clevis 363 to an upwardly extending arm 358 forming an integral part of the movable jaw 343. As a result, as the jaw pneumatic actuator 357 is actuated in one direction or the other, it closes and opens the clamp 95 by moving the movable jaw 343 toward or away from the fixed jaw 335, depending upon the direction of actuation.

The clamp 95 and the other components of the clamp subassembly are moved toward and away from the deburring subassembly 333 by the clamp feed hydraulic actuator 99. More specifically, as described above with respect to FIG. 2, the axis of the clamp feed hydraulic actuator 99 and, thus, its shaft 369 lies parallel to the axis of a drill 35 held in the clamp 95. A clevis 369 attaches the closed end of the cylinder of the clamp feed hydraulic actuator 99 to the vertical support plate 271. The tip of the shaft 367 of the clamp feed hydraulic actuator 99 is connected to the jaw bracket 377 via a clevis 373. When the clamp 95 is in a position to receive a drill in the manner herein described, the shaft 367 of the feed clamp hydraulic actuator 99 is extended. The clamp and, thus, a drill held by the clamp is moved toward the deburring subassembly 333 by actuating the feed clamp hydraulic actuator 99 such that its shaft 367 is retracted.

Supported by a bracket 371, attached to the cylinder of the clamp feed hydraulic actuator, in a position above the clamp feed hydraulic actuator 99 is the clamp feed liner potentiometer 100. The tip of the shaft 102 of the clamp feed linear potentiometer is attached to the nearest actuator support plate 355 of the clamp subassembly 331. As a result, as the clamp 95 is moved toward and away from the deburring subassembly 333 as a result of the actuation of the clamp feed hydraulic actuator 99, the shaft 102 of the clamp feed linear potentiometer 100 is moved in and out to vary the resistance of the potentiometer. As a result, the output (i.e., resistance) of the clamp feed linear potentiometer 100 is linearly related to the position of the clamp 95. As will be appreciated from the following description this clamp feed information is utilized to determine the length of the drill flutes of the drill 35 being deburred and sorted.

Figure 21:
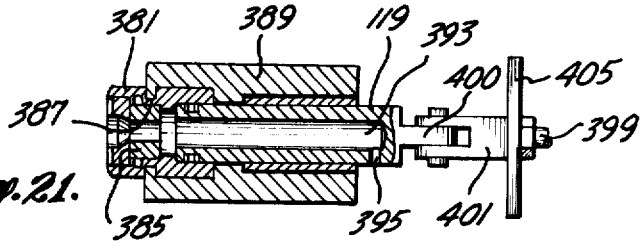
FIG. 21 is a cross-sectional view along line 21—21 of FIG. 19.
Figure 22:
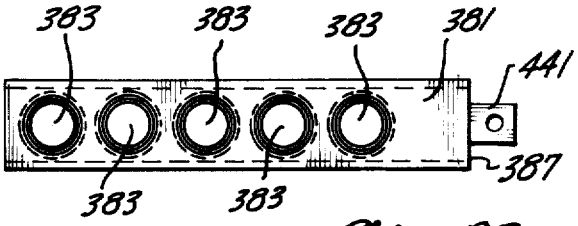
FIG. 22 is a front view of a slide suitable for use in the deburring and flute length station illustrated in FIG. 19.

The deburring subassembly 333 includes a slide 381, best illustrated in FIG. 22. The slide 381 is an elongate block having a rectangular cross-sectional configuration. The slide includes a plurality of transverse apertures 383—five in the illustrated embodiment of the invention—that extend between a pair of opposed faces. Each aperture receives a deburring bushing 385 (FIG. 21). The deburring bushings 385 may be threaded into, snapped into or in any other suitable manner mounted in one of the apertures 383, near the side facing the drill 35 when the slide 381 is mounted in the deburring subassembly in the manner hereinafter described. The other end of each aperture 383 is formed to receive the bushing lock cylinder 119.

A longitudinal guide slot 387 is formed in each of the other pair of opposed faces of the slide 381. The longitudinal slots 387 each coact with a tooth formed in the inside of the legs of a U-shaped aperture formed in a guide block 389. The guide block 389 is mounted on the vertical support plate 271 in alignment with the clamp 95. The guide block is also mounted such that the slide 381 is movable through an aperture 391 in the vertical support plate 271 in a direction orthogonal to the direction of movement of the clamp 95. Thus, the block is positioned such that the slide 381 can be positioned so that each of the bushing apertures 383 can be aligned with a drill 35 held by the clamp 95.

The guide block 389 also supports the bushing lock cylinder 119. As previously discussed, the bushing lock cylinder 119 has an elongate central aperture 393 (FIG. 21) adapted to be pressurized. The pressurizing air enters the central aperture 393 via a transverse aperture 395. After the bushing aperture 383 is moved into an aligned position in the manner herein described, the bushing lock cylinder 119 is moved from its retracted or unlocked position to a locked position by the lock pneumatic actuator 121, as described above. That is, when the bushing lock cylinder 119 is in its retracted position the slide 381 is free to slide back and forth in the direction of the longitudinal slots. When the bushing lock cylinder in in its locked position the tip of the locking cylinder 119 enters the "back" side of the aligned bushing aperture 383 and, thus, prevents slide movement. The bushing lock cylinder 119 is moved between its extended (locked) and retracted (unlocked) positions by the lock pneumatic actuator 121. The closed end of the cylinder of the lock pneumatic actuator 121 is attached via a clevis 397 to the vertical support plate 271. The tip of the shaft 399 of the lock pneumatic actuator is connected by a clevis 401 to an arm 400 extending outwardly from the downstream end of the bushing lock cylinder. Mounted between the clevis 401 and the shaft 399 is a plate 405 that is adapted to act on the actuating elements of LS10 and LS11, which are also mounted on the vertical support plate 271.

The slide 381 is positioned by three axially aligned, serially connected bushing position pneumatic actuators mounted on an arm 411 attached to and projecting outwardly from vertical support plate 271 on the opposite side of the vertical support plate 271 from the guide block 389. The arm 411 is positioned beneath the aperture 391 in the vertical support plate 271. Two of the bushing position pneumatic actuators include a common cylinder housing 413 slidably mounted in a support 415 mounted atop the arm 411. Extending outwardly from either end of the common cylinder housing 413 are the shafts 417 and 419 of the two bushing position actuators. One of the shafts 417 is attached to a bracket 421 located at the outer end of the arm 411. The other shaft 419 is connected by a clevis 431 to the closed end of the cylinder of the third bushing position pneumatic actuator 435. The shaft 437 of the third bushing position pneumatic actuator 435 is connected by a clevis 439 to an arm 441 extending outwardly from the adjacent end of the slide 381.

As best illustrated in FIG. 8, the position of the shafts of the three bushing position pneumatic actuators are controlled by valves V10 through V13. Depending upon which shafts are extended or retracted, one of the five bushings is positioned in axial alignment with a drill 35 held by the clamp 95.

Mounted on short arms 443 extending orthogonally outwardly from one edge of the arm 411 is a further plate 445. Mounted on the further plate 445 by end supports 446 is a guide rod 447 that lies parallel to the direction of movement of the slide 381. Slidably mounted on the guide rod 447 is a plate 449. The plate 449 is connected to a projection 451 extending orthogonally outwardly from the clevis 439 attached to the shaft of the third bushing position pneumatic actuator 435. Thus, the position of the plate 449 tracks the position of the slide 381. Formed integrally with, or affixed to, the plate 449 are a plurality of switch actuator projections 453. The switch actuator projections 453 control the closed/open state of LS7, LS8 and LS9 (not illustrated in FIG. 19) based upon the position of the slide 381. Thus, the open/close state of LS7, LS8 and LS9 denote which bushing is aligned with a drill 35 held by the clamp 95.

Sorting Station

Figure 23:
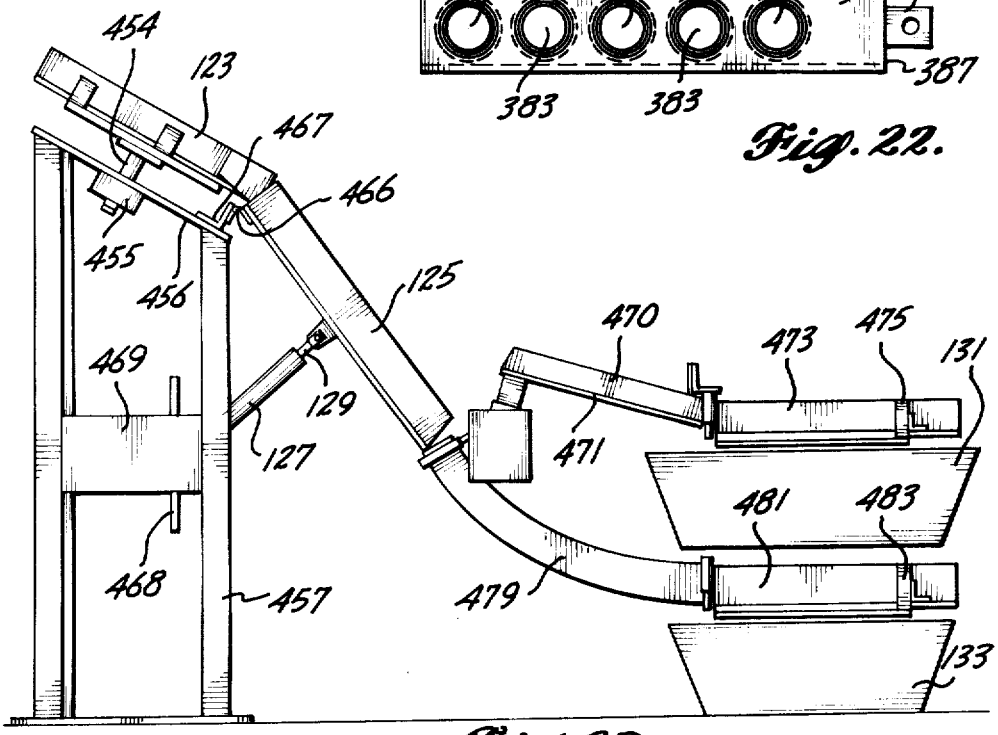
FIG. 23 is a side elevational view of a sorting station included in the preferred embodiment of the invention.
Figure 24:
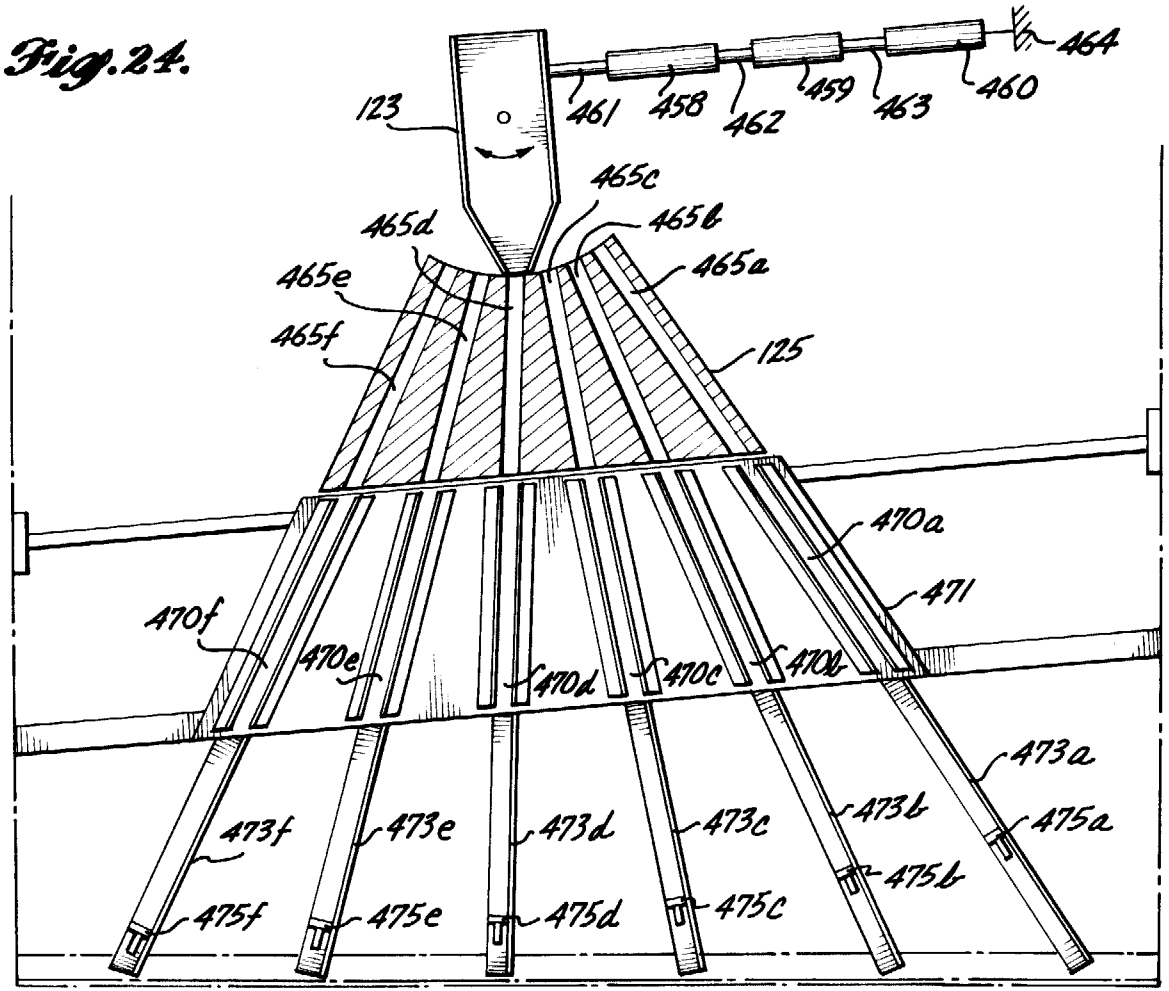
FIG. 24 is a top plan view of the sorting station illustrated in FIG. 23.

FIGS. 23 and 24 illustrate a sorting station 47 suitable for use in the preferred embodiment of the invention illustrated in FIG. 2. The sorting station includes the rotatable tray 123 that receives drills dropped by the clamp 95. As previously described, the tray 123 is inclined, as best illustrated in FIG. 23, and includes a funnel-shaped lower end, as best illustrated in FIG. 24. More specifically, the tray 123 is mounted atop a shaft 454 rotatably mounted in a bushing 455. The bushing 455 is affixed to the bottom face of an inclined plate 456 mounted on top of four legs 457. The shaft passes through an aperture in the plate 456 and, thereby, into the bushing 455. The bushing is, of course, affixed to the bottom of the plate 456. Three horizontal bin select pneumatic actuators 458, 459 and 460 are serially connected together between the tray 123 and the frame of the automatic deburring and sorting machine. The shaft position state of the horizontal bin select pneumatic actuators controls which of six discrete positions the tray is in at any particular time. More specifically, the shaft 461 of the first horizontal bin select pneumatic actuator 458 is connected to the tray 123; the shaft 462 of the second horizontal bin select pneumatic actuator 459 is connected to the cylinder of the first horizontal bin select pneumatic actuator 458; and, the shaft 463 of the third horizontal bin select pneumatic actuator 460 is connected to the cylinder of the second horizontal bin select pneumatic actuator 459. The cylinder of the third horizontal bin select pneumatic actuator 460 is connected to the frame 464 of the automatic deburring and sorting machine. Further, the shafts 461, 462 and 463 of the three horizontal bin select pneumatic actuators are all coaxially oriented along an axis that is offset from the rotational axis of the tray. Consequently, selected actuation of the horizontal bin select pneumatic actuators rotates the tray to discrete positions determined by the position (extended or retracted) of the shafts of the actuators.

Each of the six discrete positions aligns the funnel end of the tray with one of the channels 465*a*, 465*b*, 465*c*, 465*d*, 465*e* and 465*f* of the fan-shaped diverter 125 whose vertical position is controlled by the diverter pneumatic actuator 127. More specifically, as previously described, the upper end of the fan-shaped diverter 125 is hinged along a horizontal axis. In this regard, as illustrated in FIG. 23, one flange of a hinge 466 is connected to a bracket 467 mounted atop the lower end of the inclined plate 456. The other flange of the hinge is attached to the bottom of the fan-shaped diverter 125. The bottom of the fan-shaped diverter 125 is also attached to the tip of the shaft 129 of the diverter pneumatic actuator 127 such that the fan-shaped diverter 125 can be vertically positioned about the hinge axis of the hinge 466. In this regard, the other end of the diverter pneumatic actuator is connected to a vertical cross plate 468 supported by a pair of vertical side plates 469 attached to the legs 457. The fan-shaped diverter can be positioned in either of two vertical positions. When the fan-shaped diverter 125 is in its upper position the lower ends of the channels 465*a–f* are aligned with the upper end of corresponding channels 470*a–f* supported by an inclined plate 471. The plate channels 470*a–f* direct the drills to the aligned one of a plurality of right angle elements 473*a–f*. Located near the other end of each of the right angle elements is a stop 475*a–f*. After a drill leaves the plate channel 470*a–f* it slides down the corresponding right angle element 473*a–f* into the upper bin 131 aligned with the open side of the element.

When the fan-shaped diverter 125 is in its lower position, drills leaving the diverter channel 465*a–f* enter the aligned one of six downwardly curved tubes 479. The lower end of each tube is aligned with a right angle element 481 similar to the right angle element 473*a–f* aligned with the plate channels 470*a–f*. Each right angle element 481 has a stop 483 located near its other end. The right angle elements 481 and stops 483 function in a similar manner to the right angle elements 473*a–f* and end stops 475*a–f* to direct the drills received from the tubes 479 into the lower bins 133 disposed beneath the open side of the right angle elements.

Control System

Figure 25:
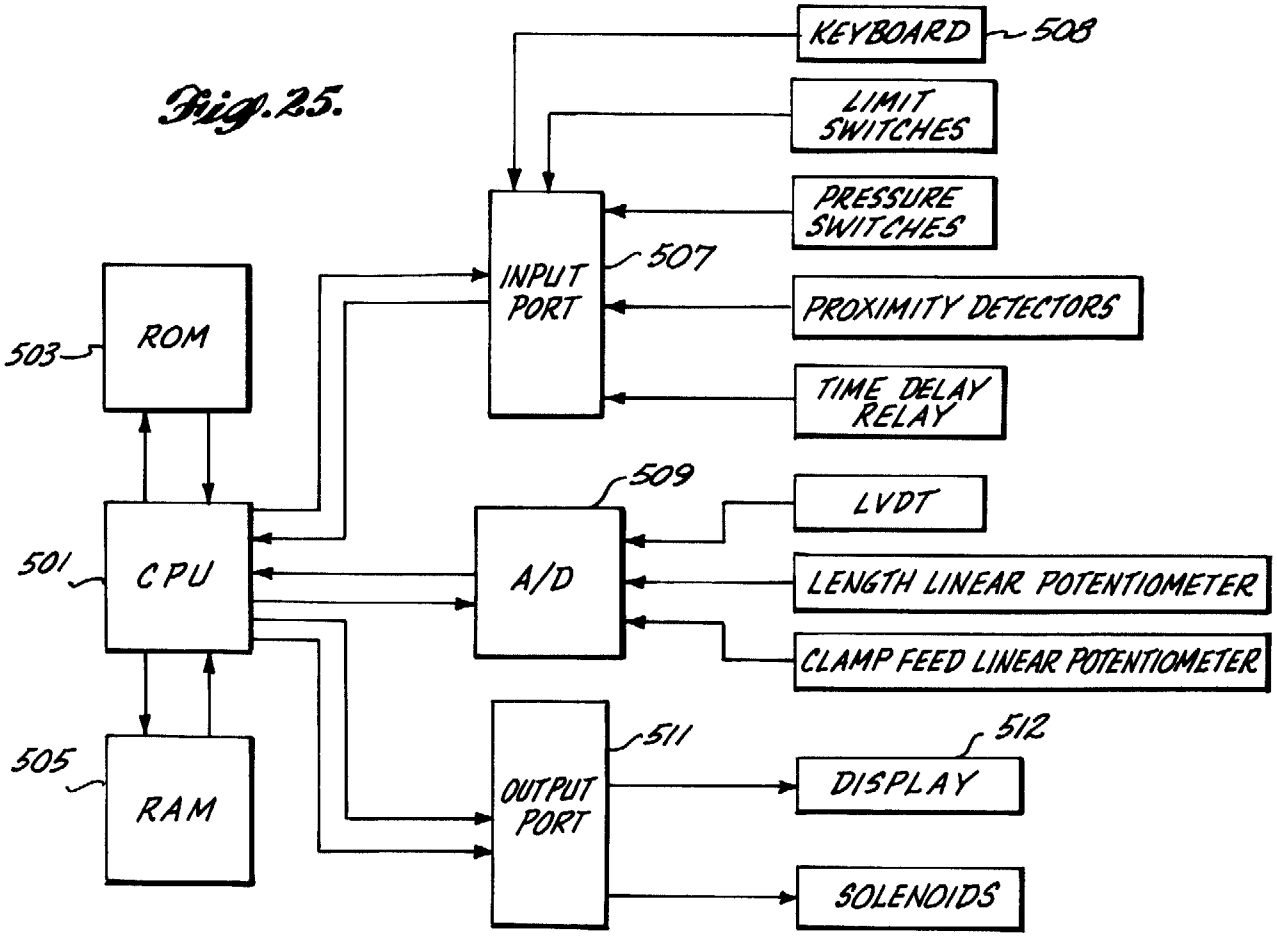
FIG. 25 is a block diagram of the control system included in the preferred embodiment of the invention; and, FIGS. 26 A, 26B and 26C are a flow diagram illustrating the operation of the central processing unit included in FIG. 25.
Figure 26A:
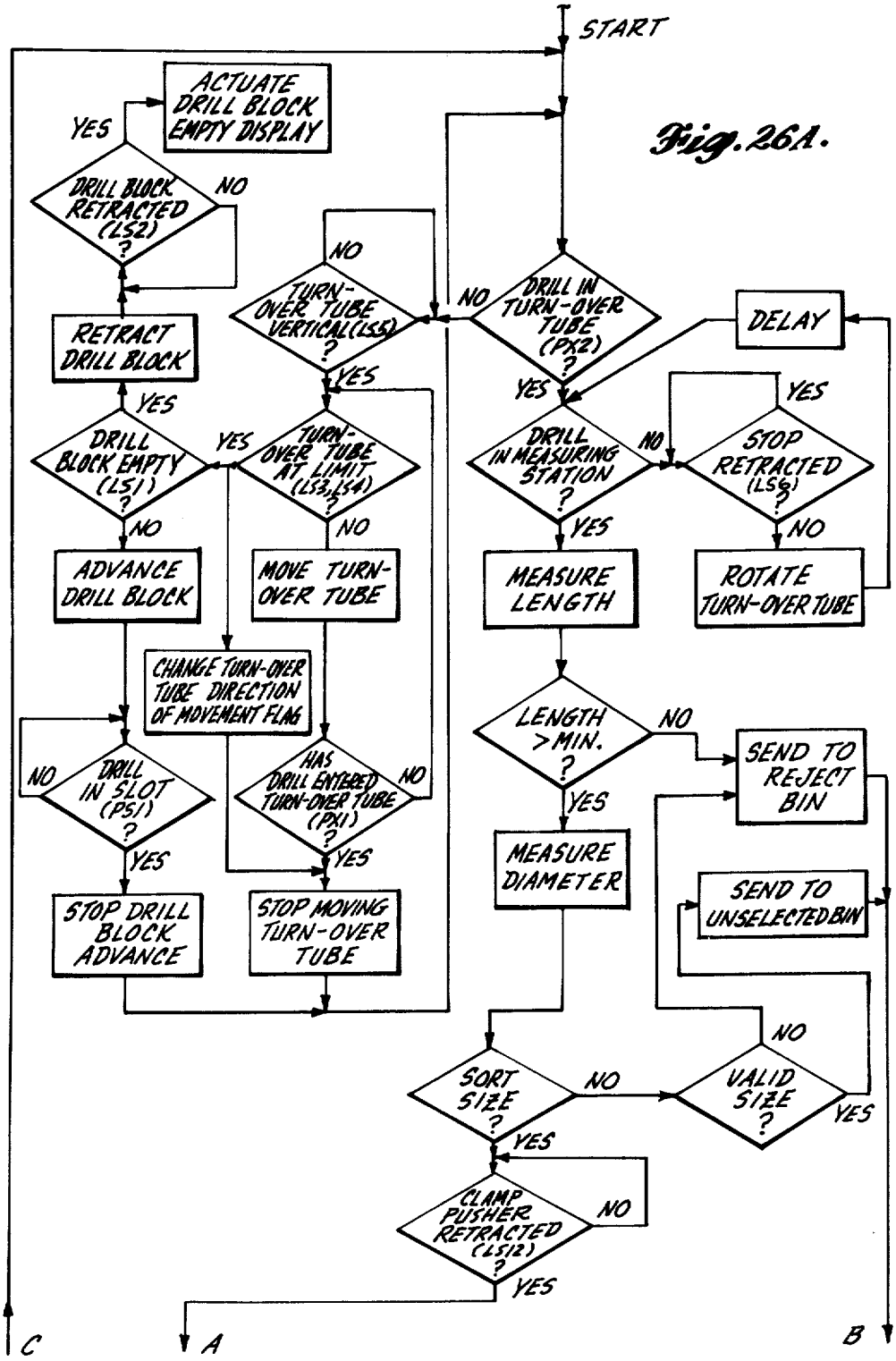
Figure 26B:
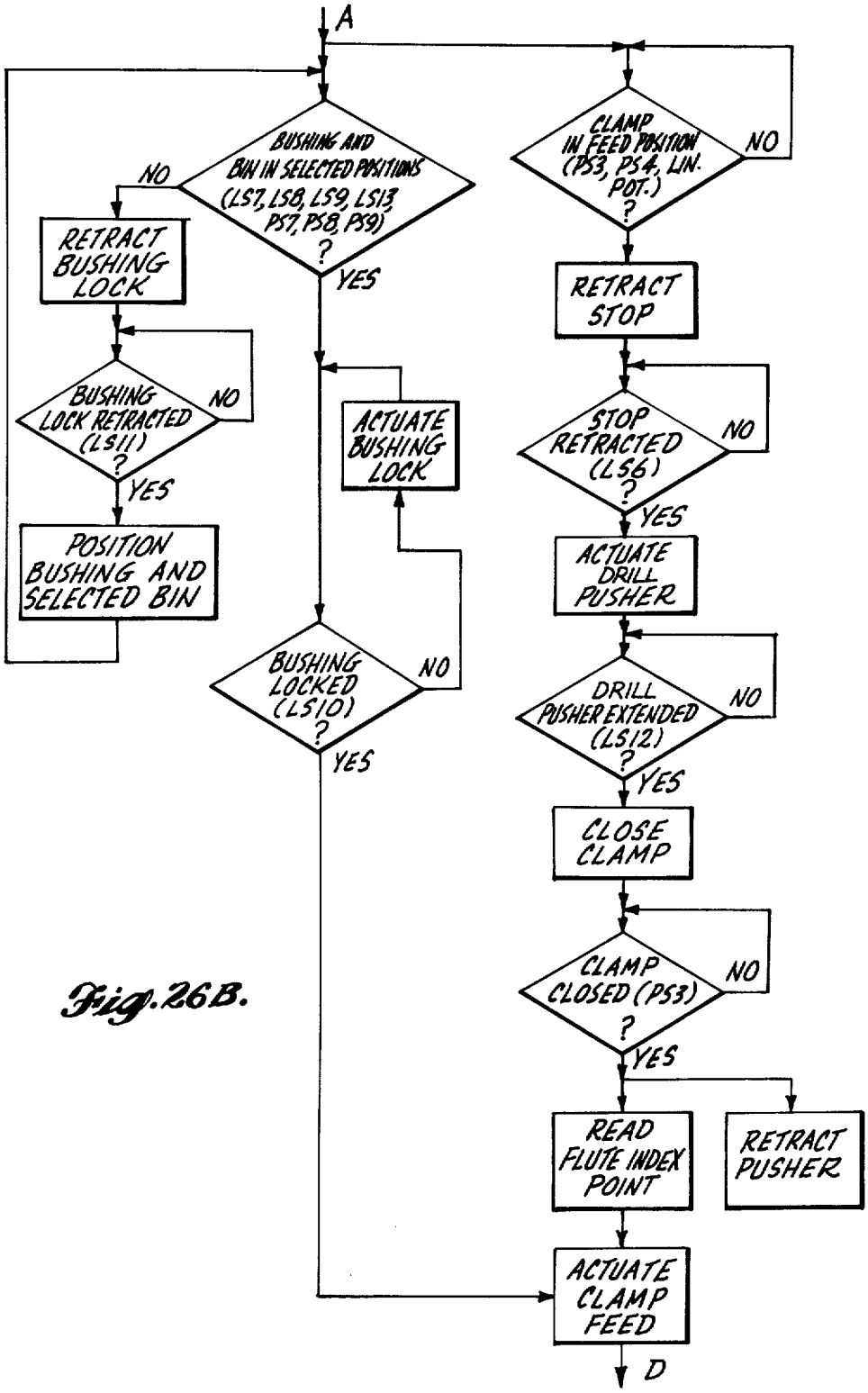
Figure 26C:
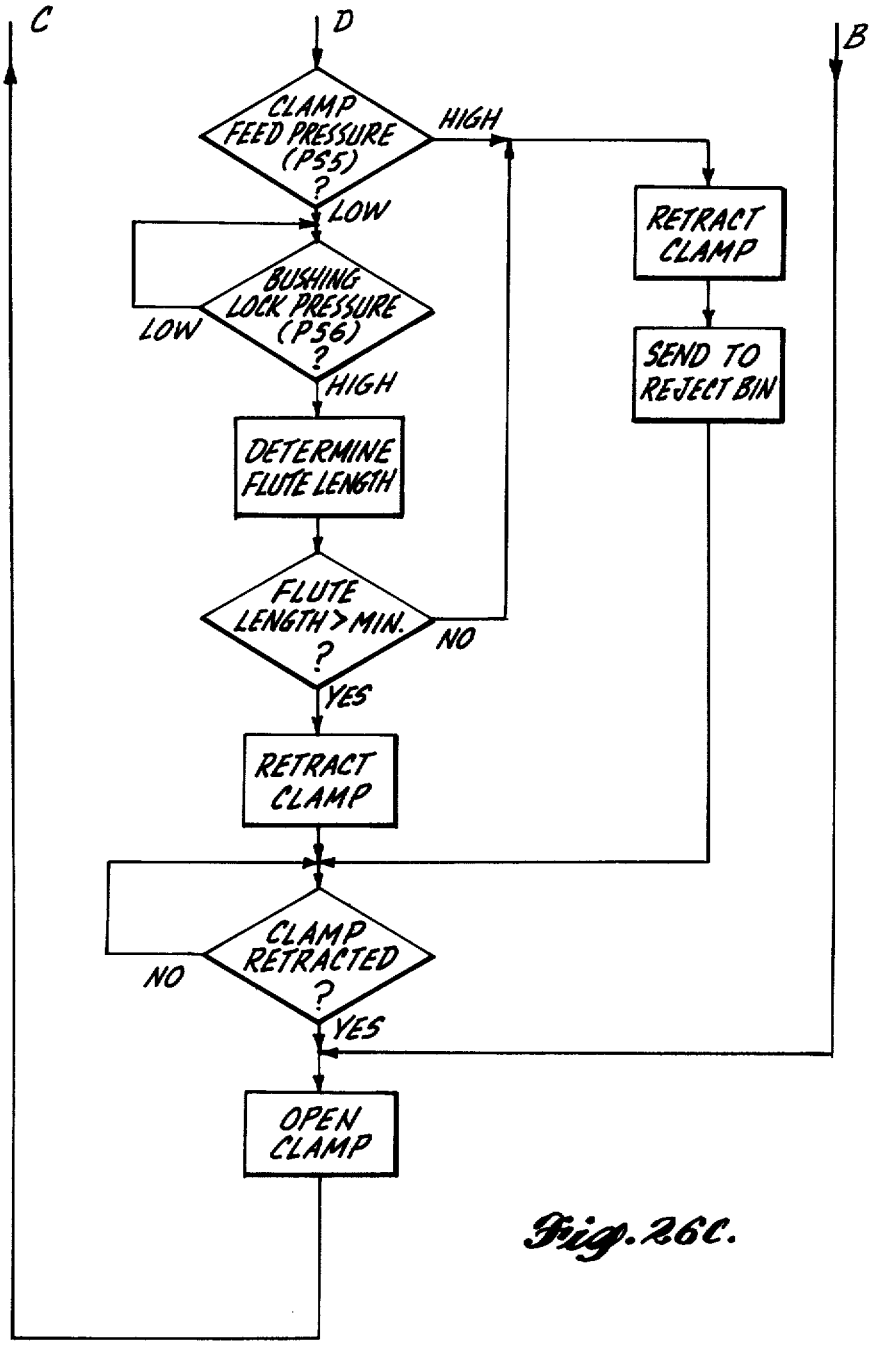

As discussed above, preferably, the actuator valves that control the position of the pneumatic and hydraulic actuator shafts are controlled by an electronic controller, such as a CPU (central processing unit) digital controller. In this regard, FIG. 25 illustrates in simplified block form the major components of a CPU digital controller, connected to the various detection elements heretofore described (i.e., the limit switches, the pressure switches, the proximity detectors, the LVDT, the length linear potentiometer and the clamp feed linear potentiometer) and to the various actuator valve solenoids. FIG. 26A, 26B and 26C are a flow diagram illustrating the operation of the CPU.

In addition to the central processing unit (CPU) 501, FIG. 25 includes: a suitable program memory, such as a read only memory (ROM) 503, which stores the operating program for the CPU 501; a suitable scratch pad memory, such as a random access memory (RAM) 505, which temporarily stores information used during the operation of the CPU; an input port 507; an analog-to-digital (A/D) conversion system 509; and, an output port 511.

The ROM and the RAM are connected to the CPU. The ROM receives sequential address codes from the CPU and, in accordance therewith, supplies program instructions to the CPU. The RAM receives data from the CPU and temporarily stores the data at addresses determined by an address code also received from the CPU. The temporarily stored data is transmitted to the CPU when requested by the CPU. The input port 507 is connected to the various limit switches, pressure switches, proximity detectors and a time delay relay. The input port is also connected to a suitable keyboard 508. In accordance with instructions received from the CPU 501, the input port forwards the data generated by these various subsystems to the CPU. The time delay relay provides delay data used to delay reading the output of the length linear potentiometer 69 and the LVDT 87 until drill bounce against the stop 61 ends. The A/D conversion system 509 is connected to the LVDT, the length linear potentiometer and the clamp feed linear potentiometer to convert the data produced by these elements from analog form to digital form in accordance with commands received from the CPU 501. Finally, the output port 511 forwards actuator commands from the CPU to the solenoids of the various actuator valves listed in FIG. 3. The output port also forwards display commands to a display 512.

The flow diagram illustrated in FIGS. 26A, 26B, and 26C, is simplified in that various subroutines normally included in an overall control system program are not illustrated. For example, FIGS. 26A, 26B and 26C do not include a calibration subroutine wherein a calibration pin is inserted in the machine and various calibration readings are made to eliminate measurement errors in the LVDT and linear potentiometer readings, prior to the actual operation of the machine. In addition, various error tests normally made during the normal operation of the program are not included in FIGS. 26A, 26B and 26C. These other normally included subroutines are not illustrated because they are well known and their inclusion in an actual embodiment of the invention will be readily apparent to those skilled in the machine tool data processing art.

Turning now to a description of the flow diagram illustrated in FIGS. 26A, 26B and 26C, after the quick change drills to be sorted have been inserted into the drill block 31 and calibration and/or other pre-operation subroutines have been completed, the automatic drill deburring and sorting sequence is started. The first step of the deburring and sorting program is a test to determine whether or not a drill is in the turn-over tube. This test is accomplished by reading the state of PX2. As previously discussed, PX2 is located near the bottom of the turn-over tube and detects the presence of a drill in the turn-over tube.

If no drill is in the turn-over tube, a test is made to determine whether or not the turn-over tube is vertical. This test is accomplished by reading the state of LS5. If the turn-over tube is not vertical, i.e., LS5 is open, then the test is repeated. The test is repeated until either one of two events occur. The first event is a determination that the turn-over tube is vertical, based on LS5 being closed by the turn-over tube actuating, i.e., closing, LS5 within some predetermined time period. In this event the program proceeds in the manner hereinafter described. The second event is the predetermined time period elapsing before LS5 is closed by the turn-over tube achieving a vertical position. In this case, the program enters a conventional shutdown subroutine (not illustrated in FIGS. 26A, 26B and 26C), which halts the operation of the machine and may create a display of the reason for the shutdown, such as TURN-OVER TUBE JAMMED.

When the turn-over tube test determines that the turn-over tube is vertical, a test is made to determine whether or not a turn-over tube limit has been reached. This test is accomplished by reading the state of LS3 and LS4. If the turn-over tube has reached its limit in one direction or the other either LS3 or LS4 is closed. If this condition is detected a turn-over tube movement direction flag is reset to the opposite direction and turn-over tube movement is stopped. Simultaneously a test is made to determine whether or not the drill block is empty. This is accomplished by reading the state of LS1. As previously described, the drill block is empty and LS1 is closed when the drill block is at the end of its path of travel. If this condition exists the drill block is retracted by applying a suitable command signal to the solenoid of V2, which causes the shaft of the feed pneumatic actuator 157 to be retracted. Thereafter, a test is made to determine whether or not the drill block has been retracted. This test is accomplished by reading the state of LS2. The test continues to occur until LS2 is found to be closed, which indicates that the drill block is retracted, i.e., in its home position. Thereafter, a DRILL BLOCK EMPTY display is created. If LS2 is not closed within a predetermined period of time after the drill block is commanded to return to its home position the machine shutdown subroutine (not illustrated) is executed and, if desired, a DRILL BLOCK JAMMED display is created.

If the drill block is not empty (because LS1 was not closed), after a turn-over tube limit was found to have been reached, the drill block is commanded to be advanced (rather than commanded to be retracted). Thereafter, a test is made to determine whether or not one or more drills have dropped into the slide 181, as previously described. This test is made by reading the state of PS1. In this regard, as previously described, when a drill drops into the slot in the slide, the air pressure applied via V1 to the advance side of the feed pneumatic actuator 157 increases. This pressure increase actuates PS1 to indicate that a drill has dropped into the slot. When this situation occurs, the feed pneumatic actuator air pressure received via V1 terminates and drill block advancement stops. Further, because the air pressure applied to the advance side of the feed pneumatic actuator 157 ends the force created by that actuator the pressing of the drills against the leading edge of the slot in the slide terminates. As a result, the drills are free to drop through the apertures in the slide and in PX1 into the turn-over tube as the turn-over tube and the apertures are positioned below each drill in the slot. After drill block advance movement has been commanded to terminate, the program returns to the point where a test is made to determine whether or not a drill was dropped into the turn-over tube. Since no drill is in the turn-over tube when drill block advance movement ends, because the turn-over tube is at one end of its path of travel, the turn-over tube vertical test is repeated followed by the turn-over tube limit test. As noted above, when the turn-over limit test finds that a turn-over tube limit has been reached, in addition to the drill block empty test being made, the turn-over tube direction of movement flag is reset (to the other direction) and turn-over tube movement is stopped. Since the turn-over tube limit (in the flag direction) has not been reached, the turn-over tube is commanded to move in the flag direction. Next, a test is made to determine whether or not a drill has entered the turn-over tube by reading PX1. This test is repeated until the entry of a drill triggers PX1, or until the limit of the turn-over tube path of travel is reached, as determined by LS3 or LS4 being closed. When PX1 is triggered it indicates that a drill has entered the turn-over tube, turn-over tube movement is stopped. As previously discussed, movement of the turn-over tube is controlled by an air-over-oil system. Consequently, turn-over tube movement stops substantially instantaneously.

The operation of the CPU now cycles back to the point where a test is made to determine whether or not a drill is in the turn-over tube. Since a drill is now in the turn-over tube, the result of the test is positive (i.e., PX2 is triggered on). Next, a test is made to determine whether or not a drill is in the measuring station. The information required to respond to this test is stored in a suitable memory such as the RAM and is based on whether or not the stop has been commanded to retract since the last rotation of the turn-over tube. If such a command has occurred the measuring station is empty. Contrariwise, if such a command has not occurred a drill is in the measuring station. If no drill is in the measuring station, a test of the state of the mesuring station stop is made. This test is accomplished by reading the state of LS6. If LS6 is closed, indicating that the stop is retracted, the test is repeated until the stop is found not to be retracted based on LS6 being open. Again, if the test is repeated for an unacceptably long period of time, the machine shutdown subroutine is entered and a display, such as STOP JAMMED, is produced, if desired. After the stop has been found not to be retracted, turn-over tube rotation is commanded. Then a delay adequate for the turn-over tube to rotate and any drill bounce against the stop to end is allowed to elapse. Thereafter, the program recycles to the point where the test is made to determine whether or not a drill is in the measuring station. Since a drill is now in the measuring station, measurement of the length of the drill is commanded. As a result, the drill length is measured by the linear length potentiometer and PX3 in the manner previously described. Thereafter, a test is made to determine whether or not the overall length of the drill is greater than a minimum length. If the drill length is found to be less than the minimum length the drill is sent to a REJECT bin. This is accomplished by retracting the stop and allowing the drill to enter the clamp, and then opening the clamp, after the tray and the fan shaped diverter are positioned to direct the drill to the REJECT bin. These steps take place without the diameter of the drill being measured, as next described, because the diameter measuring fixed and movable jaws 79 and 81 may close on the adapter of the drill. As a result, a valid diameter measurement would not be obtained.

After the overall length of the drill has been measured and found to be above the acceptable minimum length, measurement of the diameter of the drill is commanded. Thereafter, a test is made to determine whether or not the result of the diameter measurement indicates that the drill is or is not one of the size drills to be sorted. If it is not a size to be sorted a test is made to determine whether or not the drill is a valid size drill. In this regard, either the RAM or the ROM, as desired, stores the sizes of all of the drills that could be sorted by the automatic deburring and sorting machine even though only a limited number of sizes (such as five) are actually sorted. If the drill is a valid size drill, it is sent to an UNSELECTED drill bin. This is accomplished by retracting the stop (FIG. 26B) and allowing the drill to enter the clamp. Then the clamp is opened to drop the drill into the rotatable tray 123, after the rotatable tray and the fan-shaped diverter have been suitably positioned to direct the drill to the UNSELECTED bin. If the drill is determined to be an invalid size drill it is sent to a REJECT bin in the manner previously described.

If the overall length of the drill is determined to be greater than the minimum length and the diameter of the drill is determined to be one the sizes to be sorted, a test is made to determine whether or not the clamp pusher is retracted. This is accomplished by reading the state of LS12. If the clamp pusher is extended LS12 is closed. Contrariwise, if LS12 is open, the clamp pusher is determined to be in its retracted position. If the clamp pusher is found not to be retracted, the test is repeated for a predetermined period of time. If the clamp pusher does not retract prior to the period of time elapsing the machine shutdown subroutine is entered and, if desired, a PUSHER JAMMED display is created. When the clamp pusher is found to be retracted, the program shifts from point A in FIG. 26A to point A in FIG. 26B.

As illustrated in FIG. 26B, next two paths are simultaneously followed, one path relates to positioning the bushing and the sorting station mechanism and the other path relates to positioning of the drill in the clamp. Turning first to the bushing and sorting station path, first a test is made to determine whether or not the bushing and bins are in the required positions. This is accomplished by reading the states of LS7, LS8, LS9, LS13, PS7, PS8 and PS9 and comparing them with the commanded position. If the bushing slide, the fan-shaped diverter and the rotatable tray bins are in the commanded positions, no additional action is necessary, except to command the actuation of the bushing lock cylinder. Thereafter, a test is made to determine whether or not the bushing lock cylinder is in the commanded position. This test is accomplished by reading the state of LS10. The test is repeated until the bushing lock cylinder is determined to be in the locked position. If a predetermined period of time elapses before this condition is achieved, the machine shutdown subroutine is entered and, if desired, a BUSHING LOCK JAMMED display is created. After the bushing lock cylinder is found to be in the locked position, the program shifts to a point in the hereinafter described clamp sequence where clamp feed is commanded.

If the bushings and bins are found not to be in the commanded positions, the retraction of the bushing lock cylinder is commanded. Thereafter a test is made to determine whether or not the bushing lock cylinder is retracted. This is accomplished by reading the state of LS11. If the bushing lock cylinder is not retracted, the test is repeated. The test is repeated for a predetermined period of time. If the period of time elapses before the bushing lock cylinder is found to be retracted, the machine shutdown subroutine is entered and, if desired, a BUSHING LOCK display is created.

After the bushing lock cylinder is determined to be retracted, the bushing is positioned by adjusting the position of the slide. At the same time, the appropriate bin to receive the drill is selected by suitably positioning the rotatable tray and the fan-shaped diverter in the manner previously described. As previously discussed, in the preferred embodiment of the invention, bin selection is based on both the diameter and length measurements while bushing positioning is based only on the diameter measurement.

After the bushing position and bin selections have been commanded, tests are again made to determine whether or not the slide, the fan-shaped diverter and the rotatable tray are in the commanded positions. As before, these tests are accomplished by reading the states of LS7, LS8 and LS9, LS13 and PS7, PS8, PS9 and comparing them with the commanded positions. These tests are repeated until the desired positions are reached. If a predetermined period of time elapses before this happens the machine shutdown subroutine is entered and, if desired, a SLIDE JAMMED or BIN SELECTOR JAMMED display is created, as appropriate.

As noted above, simultaneously with the slide being repositioned (if required) and the bin selection mechanism being changed (if desired), the drill is positioned in the clamp. The first step along this path is a test to determine the state or attitude of the clamp, and whether or not the clamp is in the feed position. This is accomplished by reading the state of PS3 and PS4, and the output of the length linear potentiometer 69. These tests reoccur until the clamp is found to be in the partially open or feed attitude and in the feed (upstream) position, or a predetermined period of time elapses. If the time elapse occurs first the machine shutdown subroutine (not illustrated) is entered and, if desired, a CLAMP JAMMED display occurs.

After the clamp is determined to be partially open and in the feed position, the stop is commanded to be retracted. Then a test is made to determine if the stop is retracted. This test is accomplished by rending the state of LS6. The test is repeated until the stop is determined to be retracted. If a predetermined period of time elapses before this condition is achieved, the machine shutdown subroutine is entered and, if desired, a STOP JAMMED display is created.

After the stop is retracted and a delay occurs adequate to allow a drill to slide into the partially open drill, the clamp pusher is extended. As previously described, the drill pusher pushes the drill into the clamp such that the shoulder of the adapter of the quick change drill presses against the stop 353 located at the downstream end of the clamp. Next, a test is made to determine whether or not the drill pusher is extended by reading the state of LS12. Again, this test is repeated until the drill pusher is determined to be extended or a period of time elapses. In the latter event, the machine shutdown subroutine is entered and, if desired, a DRILL PUSHER JAMMED error display is created.

The clamp is now commanded to close. Then a test is made to determine if the clamp is closed. This is accomplished by reading the state of PS3. The test is repeated until the clamp is determined to be closed or a predetermined period of time elapses. In the latter event, the machine shut down subroutine is entered and, if desired, a CLAMP JAMMED error display is created.

Next, the pusher is commanded to retract and the acceptable flute length in the form of a flute index point is read from memory. Thereafter, if the bushing lock cylinder is actuated, the clamp feed is actuated and the clamp and the drill mounted therein are moved toward the slide. The program now shifts from point D in FIG. 26B to point D in FIG. 26C.

Next, a test is made to determine whether or not the clamp feed pressure is high or low. This test is accomplished by reading the state of PS5. If the clamp feed pressure goes high during the clamp feed stroke, either the tip of the drill is impinging on the bushing face, rather than entering the bushing aperture (which means that the drill is bent), or the drill is jammed in the bushing (which means an excessive material build up on the drill margins). If either event occurs, the clamp is commanded to be retracted. Thereafter, the rotatable tray and the fan-shaped diverter are repositioned to direct the drill to the REJECT bin. Next, a test is made to determine whether or not the clamp is retracted. After the clamp is retracted, the clamp is commanded to open, whereby the drill is dropped into the rotatable tray.

If the state of PS5 remains low, indicating that the drill is straight because it has entered the bushing, and that there is no excessive material build up on the drill margins, a test is made to determine when the bushing lock cylinder pressure shifts from low to high. This test is accomplished by reading the state of PS6. In this regard, as previously described, when the end of the flute reaches the upstream face of the bushing, the air that previously escaped from the bushing lock cylinder via the flutes can no longer escape. As a result, the bushing lock cylinder pressure increases; and, PS6 is closed. Thereafter, the flute length is determined by combining the output of the clamp feed linear potentiometer with the previously read output of the length linear potentiometer. Next, a test is made to determine whether or not the flute length is greater than a minimum value. If the flute length is found to be less than the minimum value, the clamp is commanded to be retracted and the rotatable tray and the fan-shaped diverter are repositioned to send the drill to the REJECT bin after which the clamp retraction state is tested, and the clamp is opened in the manner previously described.

If the flute length is found to be greater than the minimum value, the clamp is commanded to be retracted without any repositioning of the rotatable tray and the fan-shaped diverter occurring. Thereafter, the test is made to determine whether or not the clamp is retracted. Then, the clamp is opened. Regardless of the program path that is followed, after the clamp has been opened to release the drill, the system cycles back to the point where a test is made to determine whether or not a drill is in the turn-over tube and the just described sequence of operation is repeated. Preferably, the operations at the feed station, the measuring station and the deburring station occur simultaneously. That is, preferably, it is not necessary to completely process one drill before the next one enters the machine.

SUMMARY

At this point, it will be readily appreciated that the invention provides an automatic drill deburring and sorting machine that is particularly suited for use in deburring and sorting quick change drills particularly when such drills have two major groupings, such as six inch and jobber. In this regard, it should be noted that while the invention was designed for and the preferred embodiment of the invention is particularly useful in deburring and sorting two groups of quick change drills, the invention can be modified to debur and sort quick change drills only on the basis of drill diameter. Also, with further modifications the preferred embodiment of the invention can be modified to debur and sort regular drills, i.e., drills wherein the chuck portion of the shank has the same diameter as the flute portion. The primary modification required to accomplish this result is changing the clamp so that it is not dependent upon shoulder stop impingement and so that it can grip shanks of different diameters. Further, if sorting only is desired, the deburring function can be eliminated. In this regard, if flute length measurement but not deburring is desired, the bushing can be replaced with simple apertured collars. In addition, while the preferred embodiment of the invention includes pneumatic and hydraulic positioning actuators, obviously other types of mechanical and electromechanical positioning mechanisms can be utilized, if desired. Thus, it is to be understood that the invention can be practiced otherwise than as specifically illustrated and described herein.

The embodiments of the invention in which an exclusive property or privilege is claimed are defined as follows:

1. An automatic drill deburring and sorting machine comprising:
   - (A) loading station means for loading drills into said automatic drill deburring and sorting machine;
   - (B) measuring station means for receiving drills from said loading station means and measuring the overall length and diameter of said drills;
   - (C) deburring and flute length station means for receiving drills from said measuring station means, deburring the margins of said drills and determining the point on the drill drills where said flutes end;
   - (D) sorting station means for receiving drills from said deburring and flute length station means and directing said drills into receptacles; and,
   - (E) control station means connected to said loading station means, said measuring station means, said deburring and flute length station means and said sorting station means for controlling:
     - (1) the loading of drills into said automatic drill deburring and sorting machine by said loading station means;
     - (2) the measurement of the overall length and diameter of drills by said measuring station means;
     - (3) the deburring of drills and the determination of the point on said drills where the flute ends by said deburring and flute length station means; and,
     - (4) the directing of drills into receptacles by said sorting station means.

2. An automatic drill deburring and sorting machine as claimed in claim 1 wherein said control station means controls said loading station means such that drills are loaded one-by-one into said automatic drill deburring and sorting machine.

3. An automatic drill deburring and sorting machine as claimed in claim 2 wherein said loading station means includes:

a planar horizontal surface having a slot formed therein;

a drill block having a plurality of holes for vertically supporting a plurality of drills;

feeding means for moving said drill block across said slot such that drills in said drill block are free to drop into said slot when the holes in said drill block in which said drills are vertically supported passes over said slot; and, receiving means mounted beneath said slot for receiving, one-at-a-time, drills that drop into said slot and directing said drills to said measuring station means.

4. An automatic drill deburring and sorting machine as claimed in claim 3 wherein said receiving means includes:

a slide mounted in said slot, said slide including a single aperture for receiving drills in said slot when said aperture is positioned beneath a drill in said slot;

turn-over tube receiving means mounted beneath said aperture in said slide for receiving drills passing through said single aperture in said slide and for directing said drills to said measuring station means; and, turn-over tube positioning means for moving said slide and said turn-over tube receiving means in a direction parallel to the longitudinal axis of said slot such that the single aperture in said slide is sequentially positioned beneath drills in said slot.

5. An automatic drill deburring and sorting machine as claimed in claim 4 wherein said turn-over tube receiving means comprises a turn-over tube that is vertically oriented to receive drills passing through said single aperture in said slide and a turn-over tube rotation means coupled to said turn-over tube for rotating said turn-over tube from said vertical orientation to an inclined orientation that allows drills to slide out of said turn-over tube into said measuring station means and, thereafter, returns said turn-over tube to said vertical orientation.

6. An automatic drill deburring and sorting machine as claimed in claim 5 including a first sensing means mounted between said turn-over tube and said single aperture in said slide for detecting when a drill enters said turn-over tube and second sensing means for sensing when a drill reaches the bottom of said turn-over tube.

7. An automatic drill deburring and sorting machine as claimed in claim 6 including: a first pneumatic actuation means connected to said drill block for moving said drill block across said slot; an air-over-oil actuation means connected to said turn-over and said slide for moving said turn-over tube and said slide in a direction parallel to said slot; and, a second pneumatic actuation means connected to said turn-over tube for rotating said turn-over tube.

8. An automatic drill deburring and sorting machine as claimed in claim 2 wherein said measuring station means includes:

an inclined channel for receiving drills from said loading station means;

a retractable stop mounted in said inclined channel for stopping the sliding of drills down said inclined channel when said stop is extended;

length measuring means mounted upstream of said stop for measuring the overall length of a drill stopped by said stop; and, diameter measuring means mounted upstream of said stop for measuring the diameter of a drill stopped by said stop.

9. An automatic drill deburring and sorting machine as claimed in claim 8 wherein said length measuring means comprises:

a linear potentiometer mounted parallel to the longitudinal axis of said channel;

a potentiometer movement means connected to the shaft of said linear potentiometer for moving the shaft of said linear potentiometer from a first position upstream of a drill stopped by said stop toward said drill; and, a detector means coupled to the shaft of said linear potentiometer for detecting when the shaft of said linear potentiometer reaches the upstream end of a drill stopped by said stop, the resistance of said linear potentiometer being linearly related to the overall length of a drill when said detector means senses the upstream end of a drill stopped by said stop.

10. An automatic drill deburring and sorting machine as claimed in claim 9 wherein said diameter measuring means includes:

a fixed jaw located upstream of said stop;

a movable jaw aligned with and movable toward said fixed jaw in a direction orthogonal to the longitudinal axis of a drill stopped by said stop, said fixed and movable jaw aligned with the flutes of a drill stopped by said stop;

a linear variable differential transformer positioned so as to detect the position of said movable jaw; and, movement means connected to said movable jaw for moving said movable jaw toward said fixed jaw, the output of said linear variable differential transformer when a drill stopped by said stop is gripped between said fixed and movable jaws being linearly related to the diameter of said drill.

11. An automatic drill deburring and sorting machine as claimed in claim 10 wherein said movement means for moving said linear potentiometer includes a length pneumatic actuator and wherein said movement means for moving said movable jaw includes a diameter pneumatic actuator.

12. An automatic drill deburring and sorting machine as claimed in claim 11 wherein said length pneumatic actuator and said diameter pneumatic actuator are connected to said control means so as to be controlled by said control means and wherein said control means is connected to said retractable stop so as to control the position of said retractable stop, said control means controlling said retractable stop such that said retractable stop is retracted after the overall length and diameter of a drill stopped by said stop have been measured.

13. An automatic drill deburring and sorting machine as claimed in claim 3 wherein said measuring station means includes:

an inclined channel for receiving drills from said loading station means;

a retractable stop mounted in said inclined channel for stopping the sliding of drills down said inclined channel when said stop is extended;

length measuring means mounted upstream of said stop for measuring the overall length of a drill stopped by said stop; and, diameter measuring means mounted upstream of said stop for measuring the diameter of a drill stopped by said stop.

14. An automatic drill deburring and sorting machine as claimed in claim 13 wherein said deburring and flute length station means comprises:

a clamp for receiving drills from said measuring station means;

deburring means mounted downstream of said clamp;

movement means for moving said clamp toward said deburring means such that a drill held by said clamp is deburred by said deburring means.

15. An automatic drill deburring and sorting machine as claimed in claim 14 wherein said sorting station means includes a rotatable tray mounted beneath said deburring and flute length station means for receiving drills from said deburring and flute length station means and positioning means connected to said rotatable tray for positioning said rotatable tray in accordance with the diameter of a drill determined at said measuring station means.

16. An automatic drill deburring and sorting machine as claimed in claim 2 wherein said deburring and flute length station means comprises:

a clamp for receiving drills from said measuring station means;

deburring means mounted downstream of said clamp;

movement means for moving said clamp toward said deburring means such that a drill held by said clamp is deburred by said deburring means.

17. An automatic drill deburring and sorting machine as claimed in claim 16 wherein said deburring means includes a slide having a plurality of apertures each adapted to receive a deburring bushing, a plurality of deburring bushings, one mounted in each aperture in said slide and a positioning means for positioning said slide such that said bushings are aligned with drills held by said clamp, said control means being connected to said positioning means for positioning said slide in accordance with the diameter of a drill determined at said measuring station means.

18. An automatic drill deburring and sorting machine as claimed in claim 17 including a bushing lock for locking said slide in position after said slide has been positioned by said positioning means, said bushing lock including a chamber into which a drill moves after passing through said bushing and being deburred, said chamber being pressurized such that said pressure escapes via said flutes prior to the end of said flutes entering said bushing, the rise in pressure occurring when the end of said flutes enter said bushing determining the point on said drills where said flutes end.

19. An automatic drill deburring and sorting machine as claimed in claim 18 including a flute length linear potentiometer, the shaft of said flute length linear potentiometer connected to said clamp for moving with said clamp, the output of said flute length potentiometer being read when the pressure rise in said chamber in said bushing lock occurs.

20. An automatic drill deburring and sorting machine as claimed in claim 19 wherein said clamp is moved by a clamp pneumatic actuator.

21. An automatic drill deburring and sorting machine as claimed in claim 2 wherein said sorting station means includes a rotatable tray mounted beneath said deburring and flute length station means for receiving drills from said deburring and flute length station means and positioning means connected to said rotatable tray for positioning said rotatable tray in accordance with the diameter of a drill determined at said measuring station means.

22. An automatic drill deburring and sorting machine as claimed in claim 21 wherein said sorting station means also includes a fan-shaped diverter having at least two positions, said fan-shaped diverter positioned so as to receive drills from said rotatable tray and positioned in accordance with the overall length of a drill determined at said measuring station means.

23. An automatic drill deburring and sorting machine as claimed in claim 22 wherein the position of said rotatable tray and said fan-shaped diverter is controlled by said control means.

24. An automatic drill sorting machine comprising:

(A) loading station means for loading drills into said automatic drill sorting machine;

(B) measuring station means for receiving drills from said loading station means and measuring the overall length and diameter of said drills;

(C) flute length station means for receiving drills from said measuring station means and determining the point on said drills where said flutes end;

(D) sorting station means for receiving drills from said flute length station means and directing said drills into receptacles; and, (E) control station means connected to said loading station means, said measuring station means, said flute length station means and said sorting station means for controlling:

(1) the loading of drills into said automatic drill sorting machine by said loading station;

(2) the measurement of the overall length and diameter of drills by said measuring station means;

(3) the determination of the point on said drills where the flute ends by said flute length station; and, (4) the directing of drills into receptacles by said sorting station means.

25. An automatic drill sorting machine as claimed in claim 24 wherein said control station means controls said loading station means such that drills are loaded one-by-one into said automatic drill sorting machine.

26. An automatic drill sorting machine as claimed in claim 25 wherein said loading station means includes:

a planar horizontal surface having a slot formed therein;

a drill block having a plurality of holes for vertically supporting a plurality of drills;

feeding means for moving said drill block across said slot such that drills in said drill block are free to drop into said slot when the holes in said drill block in which said drills are vertically supported passes over said slot; and, receiving means mounted beneath said slot for receiving, one-at-a-time, drills that drop into said slot and directing said drills to said measuring station means.

27. An automatic drill sorting machine as claimed in claim 26 wherein said receiving means includes:

a slide mounted in said slot, said slide including a single aperture for receiving drills in said slot when said aperture is positioned beneath a drill in said slot;

turn-over tube receiving means mounted beneath said aperture in said slide for receiving drills passing through said single aperture in said slide and for directing said drills to said measuring station means; and, turn-over tube positioning means for moving said slide and said turn-over tube receiving means in a direction parallel to the longitudinal axis of said slot such that the single aperture in said slide is sequentially positioned beneath drills in said slot.

28. An automatic drill sorting machine as claimed in claim 27 wherein said turn-over tube receiving means comprises a turn-over tube that is vertically oriented to receive drills passing through said single aperture in said slide and a turn-over tube rotation means coupled to said turn-over tube for rotating said turn-over tube from said vertical orientation to an inclined orientation that allows drills to slide out of said turn-over tube into said measuring station means and, thereafter, returns said turn-over tube to said vertical orientation.

29. An automatic drill sorting machine as claimed in claim 28 including a first sensing means mounted between said turn-over tube and said single aperture in said slide for detecting when a drill enters said turn-over tube and second sensing means for sensing when a drill reaches the bottom of said turn-over tube.

30. An automatic drill sorting machine as claimed in claim 29 including: a first pneumatic actuation means connected to said drill block for moving said drill block across said slot; an air-over-oil actuation means connected to said turn-over tube and said slide for moving said turn-over tube and said slide in a direction parallel to said slot; and, a second pneumatic actuation means connected to said turn-over tube for rotating said turn-over tube.

31. An automatic drill sorting machine as claimed in claim 25 wherein said measuring station means includes:

an inclined channel for receiving drills from said loading station means;

a retractable stop mounted in said inclined channel for stopping the sliding of drills down said inclined channel when said stop is extended;

length measuring means mounted upstream of said stop for measuring the overall length of a drill stopped by said stop; and, diameter measuring means mounted upstream of said stop for measuring the diameter of a drill stopped by said stop.

32. An automatic drill sorting machine as claimed in claim 31 wherein said length measuring means comprises:

a linear potentiometer mounted parallel to the longitudinal axis of said channel;

a potentiometer movement means connected to the shaft of said linear potentiometer for moving the shaft of said linear potentiometer from a first position upstream of a drill stopped by said stop toward said drill; and, a detector means coupled to the shaft of said linear potentiometer for detecting when the shaft of said linear potentiometer reaches the upstream end of a drill stopped by said stop, the resistance of said linear potentiometer being linearly related to the overall length of a drill when said detector means senses the upstream end of a drill stopped by said stop.

33. An automatic drill sorting machine as claimed in claim 32 wherein said diameter measuring means includes:

a fixed jaw located upstream of said stop;

a movable jaw aligned with and movable toward said fixed jaw in a direction orthogonal to the longitudinal axis of a drill stopped by said stop, said fixed and movable jaw aligned with the flutes of a drill stopped by said stop;

a linear variable differential transformer positioned so as to detect the position of said movable jaw; and, movement means connected to said movable jaw for moving said movable jaw toward said fixed jaw, the output of said linear variable differential transformer when a drill stopped by said stop is gripped between said fixed and movable jaws being linearly related to the diameter of said drill.

34. An automatic drill sorting machine as claimed in claim 33 wherein said movement means for moving said linear potentiometer includes a length pneumatic actuator and wherein said movement means for moving said movable jaw includes a diameter pneumatic actuator.

35. An automatic drill sorting machine as claimed in claim 34 wherein said length pneumatic actuator and said diameter pneumatic actuator are connected to said control means so as to be controlled by said control means and wherein said control means is connected to said retractable stop so as to control the position of said retractable stop, said control means controlling said retractable stop such that said retractable stop is retracted after the overall length and diameter of a drill stopped by said stop have been measured.

36. An automatic drill sorting machine as claimed in claim 26 wherein said measuring station means includes:

an inclined channel for receiving drills from said loading station means;

a retractable stop mounted in said inclined ramp for stopping the sliding of drills down said inclined channel when said stop is extended;

length measuring means mounted upstream of said stop for measuring the overall length of a drill stopped by said stop; and, diameter measuring means mounted upstream of said stop for measuring the diameter of a drill stopped by said stop.

37. An automatic drill sorting machine as claimed in claim 36 wherein said flute length station means comprises:

a clamp for receiving drills from said measuring station means;

flute end means mounted downstream of said clamp;

movement means for moving said clamp toward said flute end means, such movement ending when the ends of the flutes of a drill received by said clamp means reach said flute end means.

38. An automatic drill sorting machine as claimed in claim 37 wherein said sorting station means includes a rotatable tray mounted beneath said flute length station means for receiving drills from said flute length station means and positioning means connected to said rotatable tray for positioning said rotatable tray in accordance with the diameter of a drill determined at said measuring station means.

39. An automatic drill sorting machine as claimed in claim 25 wherein said flute length station means comprises:

a clamp for receiving drills from said measuring station means;

flute end means mounted downstream of said clamp;

movement means for moving said clamp toward said flute end means, such movement ending when the ends of the flutes of a drill received by said clamp means reach said flute end means.

40. An automatic drill sorting machine as claimed in claim 39 wherein said flute end means includes a chamber into which a drill moves via an entrance aperture, said chamber being pressurized such that said pressure escapes via said flutes prior to the end of said flutes entering said entrance aperture, the rise in pressure occurring when the end of said flutes enter said entrance aperture defining the point on said drills where said flutes end.

41. An automatic drill sorting machine as claimed in claim 40 including a flute length linear potentiometer, the shaft of said flute length linear potentiometer connected to said clamp for moving with said clamp, the output of said flute length linear potentiometer being read when the pressure rise in said chamber occurs.

42. An automatic drill sorting machine as claimed in claim 41 wherein said clamp is moved by a clamp pneumatic actuator.

43. An automatic drill sorting machine as claimed in claim 25 wherein said sorting station means includes a rotatable tray mounted beneath said flute length station means for receiving drills from said flute length station means and positioning means connected to said rotatable tray for positioning said rotatable tray in accordance with the diameter of a drill determined at said measuring station means.

44. An automatic drill sorting machine as claimed in claim 43 wherein said sorting station means also includes a fan-shaped diverter having at least two positions, said fan-shaped diverter positioned so as to receive drills from said rotatable tray and positioned in accordance with the overall length of a drill determined at said measuring station means.

45. An automatic drill sorting machine as claimed in claim 44 wherein the position of said rotatable tray and said fan-shaped diverter is controlled by said control means.

* * * * *